US010687589B2

(12) United States Patent
Goldberg et al.

(10) Patent No.: US 10,687,589 B2
(45) Date of Patent: Jun. 23, 2020

(54) PROTECTIVE ENCLOSURE FOR A ZIPPER

(71) Applicant: CleanBrands, LLC, Warwick, RI (US)

(72) Inventors: Gary Goldberg, Providence, RI (US); David Harris, Hollis, NH (US); Donna Charpentier, Cranston, RI (US)

(73) Assignee: CleanBrands, LLC, Warwick, RI (US)

( * ) Notice: Subject to any disclaimer, the term of this patent is extended or adjusted under 35 U.S.C. 154(b) by 607 days.

(21) Appl. No.: 15/487,627

(22) Filed: Apr. 14, 2017

(65) Prior Publication Data

US 2017/0295892 A1 Oct. 19, 2017

Related U.S. Application Data

(60) Provisional application No. 62/322,541, filed on Apr. 14, 2016.

(51) Int. Cl.
*A44B 19/30* (2006.01)
*B65D 33/25* (2006.01)
(Continued)

(52) U.S. Cl.
CPC ..... *A44B 19/303* (2013.01); *A47C 31/007* (2013.01); *A47C 31/105* (2013.01); *B65D 33/2591* (2013.01); *E05B 65/52* (2013.01)

(58) Field of Classification Search
CPC ..... A44B 19/30; A44B 19/32; A47C 31/00
(Continued)

(56) References Cited

U.S. PATENT DOCUMENTS 1,506,286 A 8/1924 Binns
2,119,621 A 6/1938 Ferrone
(Continued)

FOREIGN PATENT DOCUMENTS

CN 1939180 A 4/2007
CN 201091425 Y 7/2008
(Continued)

OTHER PUBLICATIONS

International Search Report and Written Opinion for International Application No. PCT/US2017/027657, dated Sep. 7, 2017.
(Continued)

*Primary Examiner* — Fredrick C Conley
(74) *Attorney, Agent, or Firm* — Wolf, Greenfield & Sacks, P.C.

(57) ABSTRACT

A protective enclosure for a zipper of an article. The zipper enclosure may include an enclosure base that is attachable to the article, such as a mattress cover or padding materials for use with a bedding/furniture cover. The enclosure base may be configured to receive a one or more components of the zipper, such as the zipper slider and pull tab, upon closing of the zipper. When the zipper is closed, the enclosure base may be enclosed by an enclosure cover to contain and/or prevent migration of particles and/or organisms, such as bed bugs, allergens, dust mites, small particles and the like, from the article through an opening in the zipper chain adjacent the slider head. The enclosure may include one or more barriers for preventing migration of small particles and/or organisms past obstructions formed by the barriers.

69 Claims, 20 Drawing Sheets

(51) Int. Cl.
*A47C 31/10* (2006.01)
*A47C 31/00* (2006.01)
*E05B 65/52* (2006.01)

(58) Field of Classification Search
USPC ..... 5/482, 496–499
See application file for complete search history.

(56) References Cited

U.S. PATENT DOCUMENTS

| | | | | |
|---|---|---|---|---|
| 2,190,608 | A | 2/1940 | Poux | |
| 2,264,085 | A | 11/1941 | Loos | |
| 2,385,816 | A | 10/1945 | Krupp | |
| 2,400,731 | A | 5/1946 | Armstrong | |
| 2,422,249 | A | 6/1947 | Malluk | |
| 2,477,563 | A | 8/1949 | Angus | |
| 2,494,249 | A | 1/1950 | Krupp | |
| 2,496,878 | A | 2/1950 | Krupp | |
| 2,907,055 | A | 6/1959 | Berman | |
| 3,005,247 | A | 10/1961 | Doelter | |
| 3,070,986 | A | 1/1963 | Hart | |
| 3,138,842 | A * | 6/1964 | Arthur | A44B 19/301 24/615 |
| 3,292,748 | A | 12/1966 | Rifkin | |
| 3,310,889 | A | 3/1967 | Samuels | |
| 3,319,743 | A | 5/1967 | Pelavin et al. | |
| 3,389,441 | A | 6/1968 | Heimberger | |
| 3,965,706 | A | 6/1976 | Davis | |
| 4,164,797 | A | 8/1979 | Golembeck | |
| 4,368,562 | A | 1/1983 | Minami | |
| 4,397,378 | A | 8/1983 | Lee | |
| 4,514,884 | A | 5/1985 | Kaneko | |
| 4,782,563 | A | 11/1988 | Kusayama | |
| 4,873,750 | A | 10/1989 | Tracy | |
| 4,976,121 | A | 12/1990 | Wake | |
| 5,065,602 | A | 11/1991 | Williams et al. | |
| 5,081,855 | A | 1/1992 | Terada et al. | |
| 5,177,884 | A | 1/1993 | Rullier | |
| 5,253,395 | A * | 10/1993 | Yano | A44B 19/265 24/387 |
| 5,566,475 | A | 10/1996 | Donnadieu | |
| 6,363,553 | B1 | 2/2002 | Baumgärtel et al. | |
| 6,533,335 | B2 | 3/2003 | Hudson | |
| 6,923,302 | B2 | 8/2005 | Godshaw et al. | |
| 6,948,207 | B2 | 9/2005 | Daly | |
| 7,273,139 | B2 | 9/2007 | Lantz | |
| 7,428,789 | B2 | 9/2008 | Holzer et al. | |
| 7,552,489 | B2 | 6/2009 | Bell et al. | |
| 7,591,051 | B2 | 9/2009 | Kusayama et al. | |
| 7,735,615 | B2 | 6/2010 | Looram et al. | |
| 7,849,543 | B2 | 12/2010 | Poston, Jr. et al. | |
| 8,087,111 | B2 | 1/2012 | Paris | |
| 8,307,480 | B2 | 11/2012 | Tirpan | |
| 8,375,528 | B2 | 2/2013 | Takazawa et al. | |
| 8,413,276 | B2 | 4/2013 | Rattner et al. | |
| 8,516,633 | B2 | 8/2013 | Dobin | |
| 9,545,158 | B2 | 1/2017 | Goldberg | |
| 2002/0070566 | A1 | 6/2002 | Hudson | |
| 2002/0116798 | A1 | 8/2002 | Okada et al. | |
| 2004/0020017 | A1 | 2/2004 | Nedbal et al. | |
| 2004/0250452 | A1 | 12/2004 | Farys | |
| 2005/0040559 | A1 | 2/2005 | Yang | |
| 2007/0067969 | A1 | 3/2007 | Kusayama et al. | |
| 2008/0250561 | A1 | 10/2008 | Poston | |
| 2009/0154844 | A1 | 6/2009 | Greenberg | |
| 2011/0023235 | A1 | 2/2011 | Gold | |
| 2011/0099714 | A1 | 5/2011 | Svoboda | |
| 2011/0126383 | A1 | 6/2011 | Takazawa et al. | |
| 2011/0162140 | A1 * | 7/2011 | Paris | A47C 31/105 5/499 |
| 2012/0017402 | A1 | 1/2012 | Feinberg | |
| 2012/0084918 | A1 | 4/2012 | Rattner et al. | |
| 2012/0102646 | A1 | 5/2012 | Chen et al. | |
| 2012/0117728 | A1 | 5/2012 | O'Neill | |
| 2012/0311785 | A1 | 6/2012 | Goldberg | |
| 2012/0167307 | A1 | 7/2012 | Michael | |
| 2012/0174347 | A1 | 7/2012 | Higgins | |
| 2012/0246890 | A1 | 10/2012 | Hernandez | |
| 2012/0260426 | A1 | 10/2012 | Dobin | |
| 2012/0324680 | A1 | 12/2012 | Takazawa et al. | |
| 2013/0117935 | A1 | 5/2013 | Rensink et al. | |
| 2013/0185841 | A1 | 7/2013 | Berkowitz et al. | |

FOREIGN PATENT DOCUMENTS

| | | | |
|---|---|---|---|
| CN | 201839825 | U | 5/2011 |
| CN | 106539248 | A | 3/2017 |
| EP | 1 969 971 | A1 | 9/2008 |
| WO | WO 2009/112078 | A1 | 9/2009 |

OTHER PUBLICATIONS

Caliendo, Velcro looks to "hook" the flexible packaging industry with its PRESS-LOK closure technology. Plastics Today. https://www.plasticstoday.com/content/velcro-looks-hook-flexible-packaging-industry-its-press-lok-closure-technology/84345958618775 [dated May 1, 2013; last accessed Oct. 16, 2017].
International Preliminary Report on Patentability for International Application No. PCT/US2017/027657, dated Oct. 25, 2018.
PCT/US2012/042022, Jan. 3, 2014, International Preliminary Report on Patentability.
CN201280039149.X, Nov. 3, 2014, First Office Action.
CN201280039149.X, Jul. 28, 2015, Second Office Action.
CN201280039149.X, Jan. 14, 2016, Third Office Action.
EP12801132.7, Feb. 11, 2015, Extended European Search Report.
EP15188735.3, Feb. 8, 2016, Extended European Search Report.
International Preliminary Report on Patentability for International Application No. PCT/US2012/042022, dated Jan. 3, 2014.
First Office Action for Chinese Application No. 201280039149.X, dated Nov. 3, 2014, 22 pages.
Second Office Action for Chinese Application No. 201280039149.X, dated Jul. 28, 2015, 7 pages.
Third Office Action for Chinese Application No. 201280039149.X, dated Jan. 14, 2016, 18 pages.
Extended European Search Report for European Application No. 12801132.7, dated Feb. 11, 2015, 7 pages.
Extended European Search Report for European Application No. 15188735.3, dated Feb. 8, 2016, 7 pages.
Non-Final Office Action for U.S. Appl. No. 13/494,250, dated Dec. 17, 2014, 16 pages.
Final Office Action for U.S. Appl. No. 13/494,250, dated Jul. 10, 2015, 10 pages.
Non-Final Office Action for U.S. Appl. No. 13/494,250, dated Apr. 8, 2016, 10 pages.
Final Office Action for U.S. Appl. No. 13/494,250, dated Aug. 4, 2016, 7 pages.
PCT/US2017/027657, Sep. 7, 2017, International Search Report and Written Opinion.
PCT/US2017/027657, Oct. 25, 2018, International Preliminary Report on Patentability.

* cited by examiner

PROTECTIVE ENCLOSURE FOR A ZIPPER

1. RELATED APPLICATION

This application claims the benefit under 35 U.S.C § 119(e) of U.S. provisional application Ser. No. 62/322,541, filed on Apr. 14, 2016, the disclosure of which is hereby incorporated by reference in its entirety.

BACKGROUND

2. Field

The present disclosure relates to the use of an enclosure with a zipper. In some aspects, an enclosure may be used with a zipper to contain and/or prevent the infiltration of small particles and/or organisms through the zipper.

3. Discussion of Related Art

A bed bug is a small parasitic insect that feeds on blood, including human blood. Its preferred habitat is warm houses, particularly near or inside beds and bedding or other sleep areas. To reduce the incidence of bed bugs reaching a person sleeping on a mattress, a fabric cover or encasement may be used to surround the mattress and contain bed bugs that may be present in the mattress. The encasement is typically placed around the mattress and closed by a zipper to form a barrier about the mattress that inhibits migration of bed bugs to and/or from the mattress.

Zippers are commonly used for temporarily joining portions of material, such as fabric or leather, for a wide range of articles including clothing, luggage/bags, furniture and bedding. FIG. 1 depicts a separating zipper 20 including two strips of zipper tape 22 with corresponding zipper tracks 24, 26. The zipper tracks each have a number of teeth 28 that can be meshed together to form a zipper chain 30. A retainer box 32 is provided at the end of one zipper track 24 for receiving an insertion pin 34 located at the end of the other zipper track 26. A slider head 36, having a Y-shaped channel, can be moved along the length of the zipper by pulling a pull tab 38 extending from the slider head in one direction to join opposing teeth together to form a chain that closes the zipper, or in the opposite direction to separate meshed teeth of the chain to open the zipper.

When closed, such as by pulling the slider head 36 in a closing direction (e.g., upward in FIG. 1), the zipper chain 30 may largely restrict the passage of small particles or organisms from one side of the zipper to the other. However, even when the zipper is closed, a small space (e.g., about 5 $mm^2$ in area) may nevertheless exist adjacent the slider head through which small particles or organisms, such as bed bugs, might still be able to move across the zipper.

SUMMARY

The inventors have recognized that a closed zipper may still present an opening between the slider head and the end of the zipper chain. The opening can provide a passageway through which small particles or organisms, such as bed bugs, are able to migrate from one side of the closed zipper to the other. Embodiments described herein relate to the appreciation that it would be beneficial to at least contain, if not obstruct and/or block, the migration of small particles or organisms through such a passageway. Zipper arrangements are described in various embodiments herein utilizing a protective enclosure to contain, if not obstruct, migration of particles and/or organisms that may occur across a closed zipper.

In various aspects, a zipper enclosure may include an enclosure base that is attachable to an article, for example, bedding arrangements (e.g., mattress/pillow covers, duvets, comforters, sleeping bags, etc.) or other padding materials that are opened and closed by a zipper. The enclosure base may be configured to receive a slider head upon closing of the zipper. When the slider head is positioned within the enclosure base to close the zipper, an enclosure cover may be closed on the enclosure base to contain, if not prevent, the migration of small objects such as bed bugs, other organisms or particles from the article through an opening in the zipper chain adjacent the slider head.

According to one aspect, a zipper enclosure comprises an enclosure base and an enclosure cover. The enclosure base is configured to be attached to an article that includes a zipper for joining first and second portions of the article together when the zipper is closed. The enclosure base includes a first base portion configured to be located on the first portion of the article and a second base portion that is separate from the first base portion and is configured to be located on the second portion of the article. The enclosure cover is configured to secure the first and second base portions to each other when the zipper is closed and the cover is closed on the enclosure base. The first and second base portions are separable from each other when the cover is released from the enclosure base.

According to another aspect, a mattress cover is provided for enclosing a mattress. The mattress cover comprises a bottom cover panel configured to enclose a bottom portion of the mattress, a top cover panel configured to enclose a top portion of the mattress and a zipper to removably join the top cover panel to the bottom cover panel and thereby enclose the mattress with the mattress cover. The zipper includes a chain, a slider head that is movable along the chain to open and close the zipper, and a pull tab extending from the slider to facilitate movement of the slider along the chain. The mattress cover also comprises a zipper enclosure configured to enclose the slider and one or more portions of the chain when the zipper is closed to contain migration of particles and/or organisms through the mattress cover. The zipper enclosure includes an enclosure base attached to the mattress cover adjacent the zipper and an enclosure cover configured to engage with the enclosure base to enclose the slider and the one or more portions of the chain. The enclosure base includes a first base portion attached to an outer surface of the bottom cover panel and a second base portion attached to an outer surface of the top cover panel. The first and second base portions are separable from each other when the cover is released from the enclosure base.

According to a further aspect, a zipper enclosure comprises an enclosure base, an enclosure cover and at least one barrier. The enclosure base is configured to be attached to an article that includes a zipper having a zipper chain and a zipper slider, and is configured to receive the zipper slider. The enclosure cover is attached to the enclosure base and movable between an open position to receive the zipper slider in the enclosure base and a closed position to enclose the zipper slider in the enclosure base. The at least one barrier is located on the enclosure cover to engage a portion of the zipper when the cover is moved to the closed position. The barrier includes a pre-formed contoured surface having a shape corresponding to the portion of the zipper.

BRIEF DESCRIPTION OF DRAWINGS

Non-limiting aspects of the invention will be described, by way of example, with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

Figure 1:
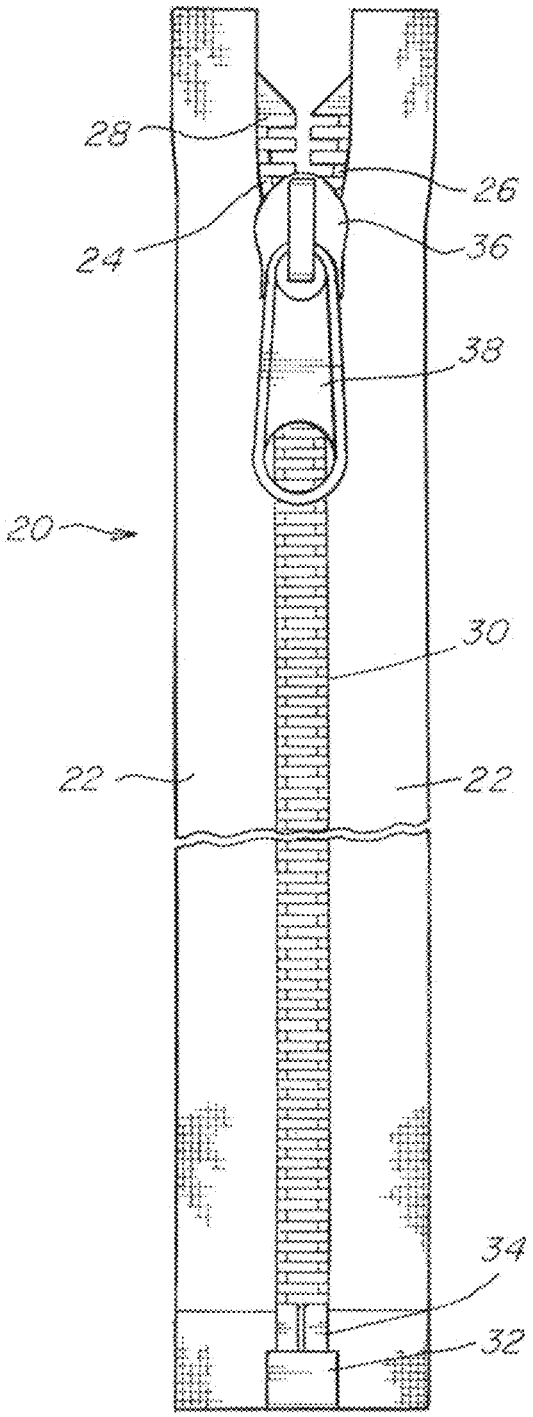
FIG. 1 is an illustration of a separating zipper.

It should be understood that aspects of the invention are described herein with reference to certain illustrative embodiments and the figures. The illustrative embodiments described herein are not necessarily intended to show all aspects of the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

Various embodiments are described in connection with a zipper enclosure for use with a covering for an article, such as a mattress cover. For instance, when enclosing the slider head of a zipper that has been closed on a mattress cover, bed bugs may be contained or obstructed from migrating out of the mattress cover, such as may occur through a small opening that can exist between the zipper slider head and the end of the zipper chain. However, the invention is not necessarily so limited, and may be used with other articles or coverings that employ a zipper for opening and closing the article or covering. For example, the zipper enclosure may be used with padding or bedding material including mattress or pillow covers, duvets, comforters, sleeping bags and the like, or bags and luggage that are opened and closed by a zipper, and which would benefit from use of a zipper enclosure to contain and/or obstruct the migration or passage of small particles or organisms as should be apparent to one of skill in the art.

For ease of understanding, the zipper enclosure is described in connection with a mattress cover that includes separate top and bottom cover portions that are joined and separated using a separating zipper.

In some embodiments, the zipper enclosure includes an enclosure base that is attachable to the mattress cover and an enclosure cover that can be closed and opened relative to the base. The enclosure base may receive one or more portions of the zipper, such as the retainer box, the slider head and the pull tab, which are thereafter enclosed when the enclosure cover is closed on the base. The enclosure base and the enclosure cover may contain and/or prevent migration of particles and/or organisms through the zipper enclosure when the cover is closed.

In some embodiments, the enclosure base may include separate first and second base portions that are individually attachable to the top and bottom cover panels of the mattress cover. The base portions may be arranged adjacent the edges of the cover panels such that a zipper chain can extend between the base portions when the zipper is closed to join the cover panels and encase the mattress. A channel for receiving portions of the zipper may be formed along the length of the enclosure base between the base portions when the base portions are drawn into position adjacent each other as the zipper is closed to join the top and bottom cover panels. A retainer, such as a post, for engaging the pull tab to retain the slider head in one or more positions may be located within the channel.

In some embodiments, the enclosure base and the enclosure cover may include one or more barrier segments that engage each other at an interface to form a barrier to prevent migration of particles and/or organisms across the interface when the cover is closed on the base. The barrier segments may also cooperate to secure the cover to the enclosure base when the cover is closed. The barrier segments may also be configured to produce an audible and/or tactile indication that the enclosure cover is fully closed and securely engaged to the enclosure base.

In some embodiments, one or more barriers may be provided to obstruct migration of particles and/or organisms. The enclosure cover may include one or more barriers for engaging one or more portions of the zipper chain when the cover is closed on the enclosure base. The barrier(s) may conform to the zipper chain when moved into engagement with the chain. The barriers may be located at each end of the cover which overlies the zipper chain. In some embodiments, the barrier(s) may feature a contoured surface corresponding to a profile of the zipper chain. For instance, the barrier(s) may include one or more barrier portions configured to overlie the zipper chain and/or hems formed when attaching the zipper chain to an article. In some instances, the barrier portions may be separated by one or more protrusions which are configured to engage with one or more portions of the zipper. For example, and without limitation, the protrusions may be configured to extend into and seal corresponding depressions or channels in the zipper tape (e.g., between the hems and the zipper chain). The protrusions may be arranged to extend along a direction generally parallel to the zipper chain. In some embodiments, each barrier portion may include one or more barrier segments with one or more recesses located between the barrier segments. For instance, each barrier segment may deform and/or compress independently from adjacent barrier segments to provide multiple contact points between the barrier(s) and the zipper chain and/or hems when the barrier(s) are engaged with the zipper chain and/or hems.

In some embodiments, a contoured surface of the barrier(s) on the enclosure cover may feature a pre-formed contoured surface. For example, and without limitation, the barrier may include one or more barrier portions, and each barrier portion may have a pre-formed contoured shape, such as a convex or concave curvature, a wavy shape, or any other suitable shape. In some embodiments, a barrier portion configured to overlie the zipper chain may have a first pre-formed shape, while a separate barrier portion configured to overlie a hem may have a second pre-formed shape that is different than the first pre-formed shape. For example, the first pre-formed shape may be a convex curved portion, and the second pre-formed shape may be a concave curved portion. However, it is to be understood that the current disclosure is not limited to any particular shapes for the barrier portion(s), and in some instances, different barrier portions may have the same pre-formed shape.

In some embodiments, the enclosure base may include one or more barriers to obstruct openings that may be present adjacent the slider head and/or the retainer box positioned within the base. The barrier(s) may be a slider barrier arranged to engage the slider head when the zipper is closed and/or a retainer box barrier arranged to engage the retainer box of the zipper. Moreover, in some embodiments, the barrier(s) provided on the cover may include an engaging portion configured to at least partially overlie and engage the slider and/or retainer box barriers when the enclosure cover is closed. In this manner, the engaging portion may reinforce the sealing about the zipper slider and/or the retainer box.

In one aspect, the barrier(s), including barriers which may be provided on the cover and/or for engagement with the slider head and/or retainer box, may include one or more compressible pads that are positioned to engage and conform to the slider head and/or the retainer box to obstruct openings through the zipper that may otherwise be present.

In some embodiments, a support may be provided to support the base portions relative to each other when the zipper is closed on the mattress cover. The support may be configured to extend from one base portion and bridge across a portion of the zipper to engage the other base portion. In this manner, the support may be a bridge that connects the base portions to one another, and the bridge may span a channel located between the base portions when connected to one another. An alignment feature may be provided to align the support and one of the base portions with the other base portion. In one aspect, the support may include a foot with a recess that receives a boss protruding from the other base portion. In some embodiments, the support may be fixed relative to one of the base portions. In other embodiments, the support may be hingedly connected to one of the base portions and may be moveable between a first position (e.g., an open position) and a second position (e.g., a closed position). When in the first position, the support does not extend across the zipper; in this manner, the channel between the base portions may be unobstructed by the support in order to facilitate joining of the zipper tracks. Thereafter, the support may be moved to the second position in which the support extends across the channel (and across the zipper) and engages the other base portion. In some aspects, the support may include one or more alignment features, such as protrusions, which engage with complementary features, such as recesses, located on the other base portion. In some embodiments, one or more alignment features may be provided to align the enclosure cover with the enclosure base as the cover is closed on the base. Each base portion may include an alignment feature that cooperates with a complementary alignment feature on the cover. In one aspect, the cover may include protrusions that are received in complementary receptacles provided on the base portions.

In some embodiments, a backing panel may be provided to support the base portions of the enclosure base to facilitate closure of the enclosure cover. The backing panel may be attachable to an inner surface of one of the mattress cover panels opposite one of the base portions. A portion of the backing panel may extend beyond the edge of the cover panel to be positioned adjacent an inner surface of the other cover panel and opposite the other base portion when the mattress cover panels are joined with the zipper. If desired, one or more barriers, such as compressible pads, may be provided on the backing panel to overlie and obstruct openings through the zipper that may otherwise be present.

Figure 2A:
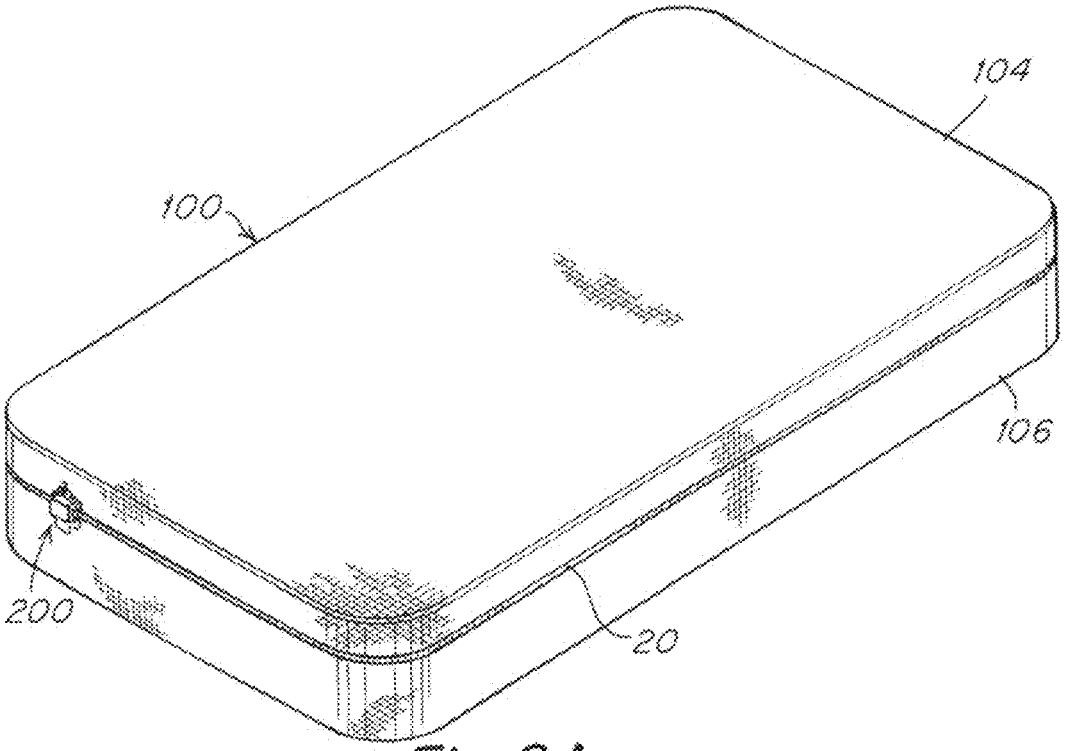
FIG. 2A is a perspective view of a mattress enclosed with a zippered mattress cover including a zipper enclosure in accordance with an illustrative embodiment.
Figure 2B:
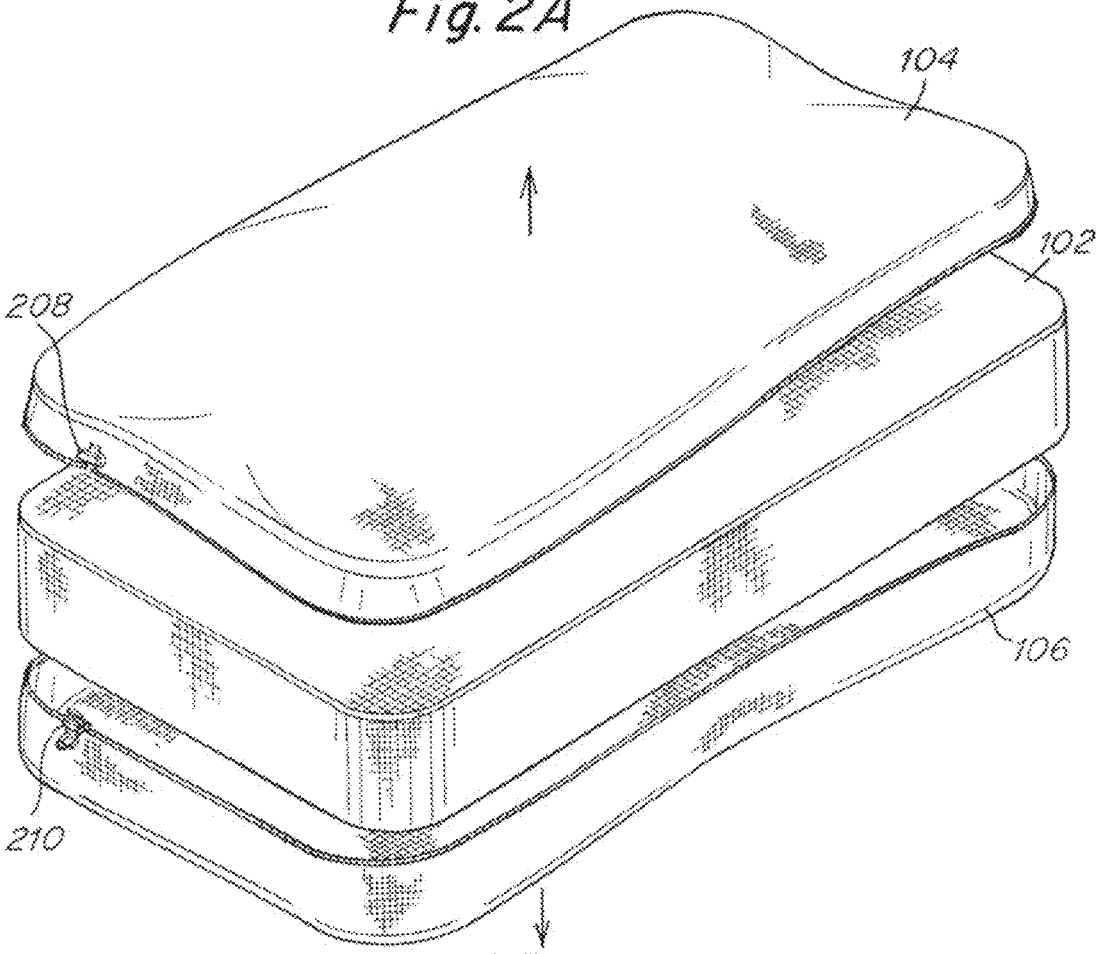
FIG. 2B is an exploded perspective view of the mattress cover of FIG. 2A.

As shown in FIGS. 2A and 2B, a mattress cover 100 for enclosing a mattress 102 may include a top cover panel 104 and a bottom cover panel 106 that may be joined together and separated from each other using a separating zipper 20 that extends about most, if not all, of the periphery of the mattress. In this manner, the top cover panel 104 may be completely separated from the bottom cover panel 106 and removed from the mattress 102 while the bottom cover panel remains in place below the mattress. Such an arrangement may be beneficial by allowing the top cover panel 104 to be removed from the mattress to be cleaned and/or changed without requiring the removal of the entire mattress cover from the mattress which can be a time consuming and difficult task, particularly if done on a frequent basis, such as may be desired by a hotel or similar establishment.

A zipper enclosure 200 may be provided on the mattress cover 100 to effectively enclose a portion of the zipper 20 that may otherwise provide a pathway for the migration of particles and/or organisms, such as bed bugs, dust mites, allergens and/or other small particles and organisms, into and out of the mattress cover through the zipper. In addition to enclosing a pathway through the zipper, the enclosure 200 may also be configured to block or obstruct the pathway to reduce, if not prevent, migration of particles and/or organisms from within the mattress cover 100 and into the zipper enclosure through the zipper or vice versa.

As illustrated in FIG. 2B, the zipper enclosure 200 may be separable into individual portions that are separately attachable to the top and bottom cover panels. When the top and bottom cover panels 104, 106 are joined together by closing the zipper 20, the individual portions of the zipper enclosure are configured to engage and be secured to each other to form the enclosure about the potential pathway through the zipper.

In one embodiment illustrated in FIGS. 3-10, the zipper enclosure 200 includes an enclosure base 202 that is attachable to the mattress cover 100 and an enclosure cover 204 that can be closed and opened relative to the base. The enclosure cover 204 may be coupled to the enclosure base 202 with a hinge 206 that permits the cover to be pivoted between open and closed positions relative to the base. In one embodiment, the hinge 206 may be a living hinge integrally formed with the enclosure base 202, although any suitable hinge arrangement may be used as should be apparent to one of skill in the art.

The base 202 is configured to receive one or more portions of the zipper, such as the retainer box 32, the slider head 36 and the pull tab 38, which are thereafter enclosed when the cover 204 is closed on the base 202. The enclosure base and the cover are configured to prevent migration of particles and/or organisms through the zipper enclosure when the cover is closed.

As illustrated, the enclosure base 202 may include a first base portion 208 and a separate second base portion 210 that are individually attachable to the top and bottom cover panels 104, 106 of the mattress cover. In one embodiment, the base portions may be sewn to the cover panels by placing a series of stitches 212 through a flange 214, 216 of each base portion. For example, the base portions may have holes (not shown in the figures) through which a suitable thread/yarn may pass for attachment of the base portions to the cover panels (e.g., fabric). It is to be understood, however, that the base portions may be attached to the cover panels using any suitable technique as should be apparent to one of skill in the art. For example, and without limitation, the base portions may be attached to the mattress cover panels using a suitable adhesive (e.g., resin, epoxy, glue, etc.), staples, or a hook and loop fastener arrangement.

Figure 5:
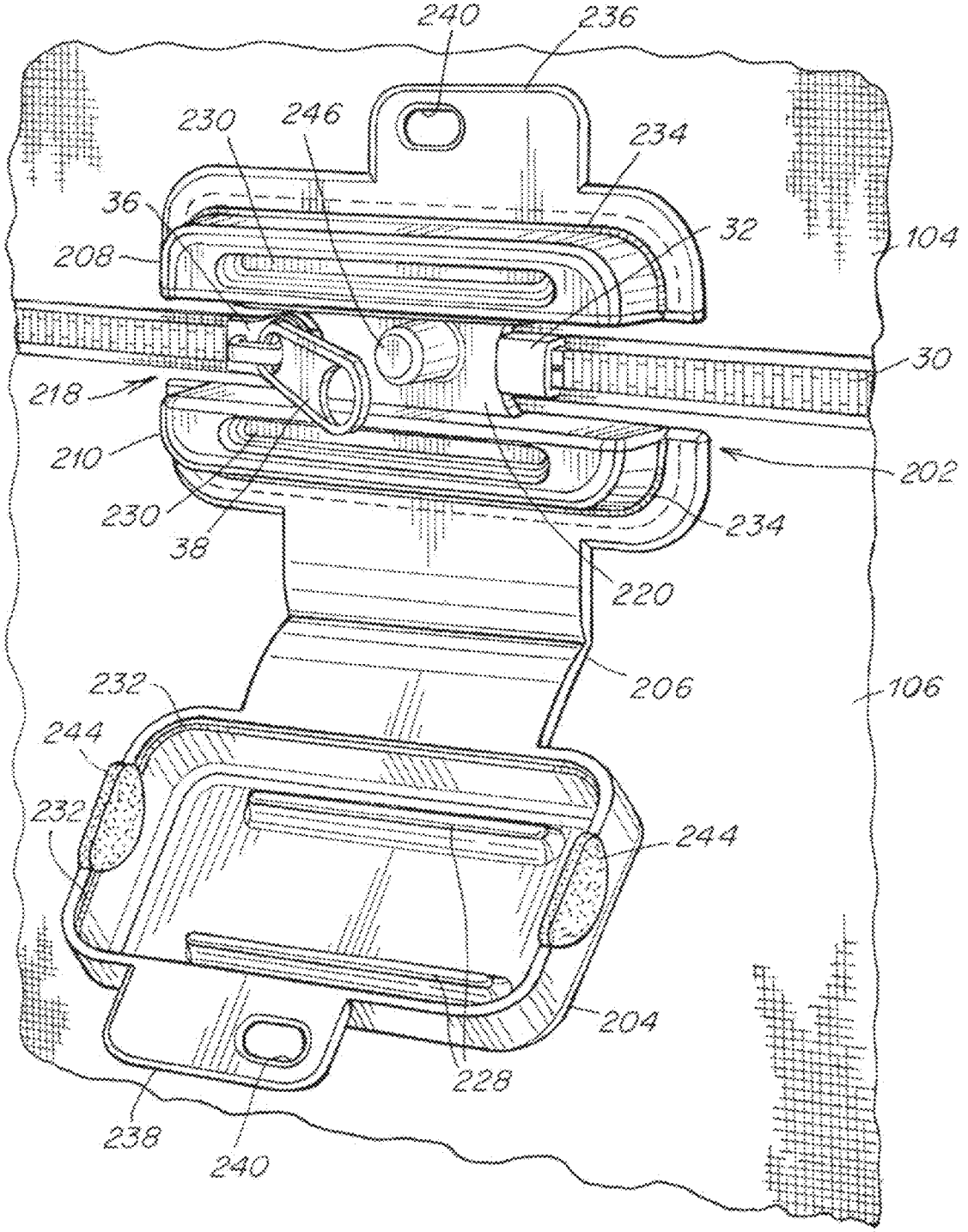
FIG. 5 illustrates the zipper in a closed configuration where the slider head is positioned at a second end of the enclosure base of FIG. 3.

The base portions 208, 210 may be arranged adjacent the edges of the cover panels 104, 106 such that the zipper chain 30 can extend along the cover panels and between the base portions when the zipper is closed to join the cover panels and encase the mattress. As shown in FIG. 5, a channel 218 may be formed along the length of the enclosure base 202 between the first and second base portions 208, 210 when the base portions are drawn into position adjacent each other as the zipper is closed to join the top and bottom cover panels. The enclosure base 202 may be configured to receive portions of the zipper, including the retainer box 32, the slider head 36, the pull tab 38 and segments of the zipper chain 30, within the channel.

For some applications, it may be desirable to provide one or more features for aligning, spacing, joining and/or maintaining the position of the first and second base portions relative to each other and form the enclosure about the zipper.

In one illustrative embodiment, the enclosure base 202 may include a support 220 (e.g., a bridge) for spacing the first and second base portions 208, 210 at a selected distance from each other so as to establish a desired width for the channel 218 for receiving the various components of the zipper. As shown, the support 220 may be integrally formed as part of the second base portion 210 and configured to extend across and bridge a portion of the zipper chain 30 toward the first base portion 208. Alternatively, if desired, the support may be formed as part of the first base portion and be configured to engage with the second base portion.

The support may be configured in a manner that corresponds closely with the retainer box and/or the slider head. In one embodiment, a first side of the support 220 has a configuration that corresponds with the retainer box 32 and a second side of the support has a different configuration that corresponds with the slider head 36. For example, and without limitation, the first side of the support may have a squared-like configuration and the second side of the support may have curved configuration, such as a U-shaped or V-shaped configuration that corresponds to the slider head.

The support 220 may include a foot 222 that is configured to engage with the first base portion 208 when the mattress cover panels are joined by closing the zipper. As shown, the foot 222 may have an elongated configuration to extend and provide support along a substantial length of the first base portion. However, the foot may have any suitable configuration as should be apparent to one of skill in the art for providing support between the base portions.

For some embodiments, one or more features may be provided to facilitate alignment of the first and second base portions as they are drawn together and into engagement with each other. In one illustrative embodiment shown in FIG. 3, a recess 224 may be provided on the foot 222 of the support for engaging with a boss 226 protruding from the first base portion. Alternatively, the boss may be provided on the foot of the support and the recess may be provided on the first base portion. As shown, the recess 224 and the boss 226 may have elongated configurations with complementary shapes that engage each other to facilitate alignment of the base portions as they are drawn together. However, it is to be understood that the alignment features may employ any suitable configurations and/or the enclosure base may employ any suitable alignment arrangement as should be apparent to one of skill in the art.

For some embodiments, the enclosure cover and/or enclosure base may include one or more features to facilitate alignment of the cover with the base and/or securement of the base portions together. In one illustrative embodiment, the enclosure cover 204 may include a pair of elongated protrusions 228, such as ribs, ridges and the like, that extend along a length of the cover. The enclosure base 202 may include a pair of elongated receptacles 230, such as hollows, cavities, recesses and the like, that similarly extend along a length of the base and which are configured to receive and engage with the protrusions 228 as the cover is closed onto the base. As shown, a receptacle 230 is provided on each of the first and second base portions 208, 210. In this manner, engagement of the protrusions 228 with the receptacles 230 assists with alignment of the first and second base portions 208, 210 relative to each other, alignment of the cover 204 with the enclosure base 202, and securement of the first and second base portions so that they do not separate from each other.

Figure 10:
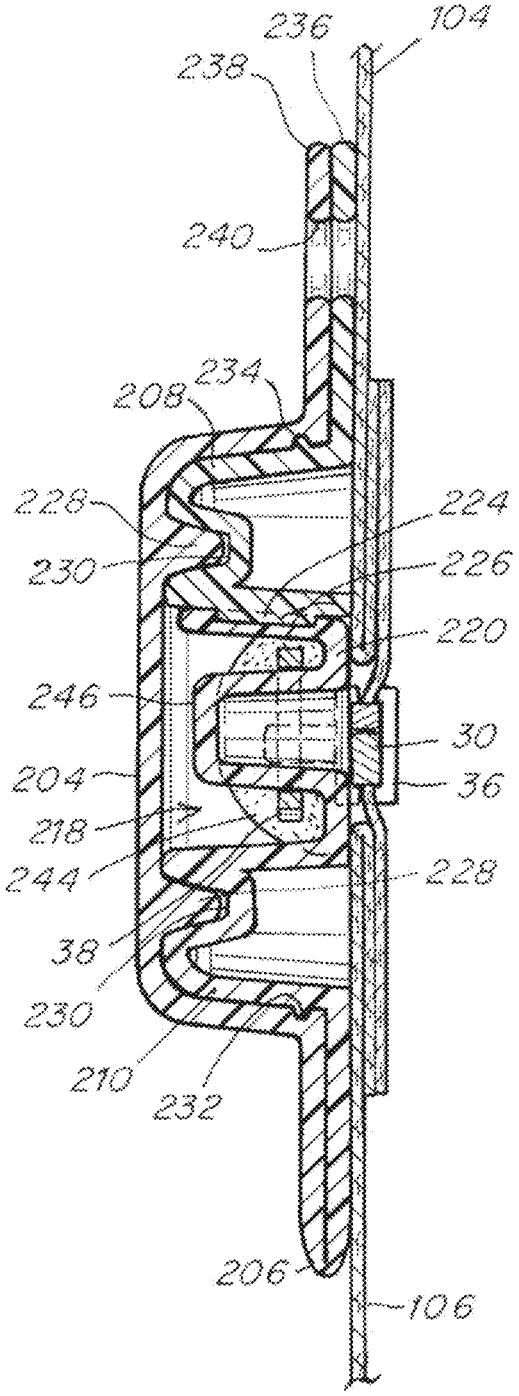
FIG. 10 is a cross-sectional view of the zipper enclosure taken along section line 10-10 of FIG. 8.

The protrusions 228 and/or the receptacles 230 may be configured to facilitate alignment and engagement with each other. In one embodiment, the protrusions 228 and the receptacles 230 may have complementary tapered shapes to assist with guiding the alignment features into engagement. As shown in FIG. 10, the width of each protrusion 228 increases in a direction from its upper end toward its lower end, and the width of each receptacle 230 decreases in a direction from its upper end toward its lower end. In this manner, the narrower upper end of each protrusion initially enters the wider upper end of each receptacle as the cover is closed on the enclosure base.

For some embodiments, the enclosure cover and/or the enclosure base may include one or more fasteners to facilitate securement of the cover to the base. In one illustrative embodiment, one or more channels 232 may extend about the inner periphery adjacent the open end of the cover 204, and one or more protrusions 234 may extend about the outer periphery adjacent the flange 214, 216 of each base portion 208, 210. The channels 232 and the protrusions 234 are configured to engage with each other in a manner that secures the cover to the enclosure base. For example, the channels and protrusions may be configured so that the channels 232 snap onto and grip the protrusions 234 when the enclosure cover is closed to secure the cover on the enclosure base.

As previously discussed, even when a zipper is sufficiently or fully closed to join mattress cover panels together, the zipper may nevertheless fail to prevent migration of bed bugs, dust mites, allergens, small particles and the like, even if only a slight gap exists. Consequently, it may be desirable to provide feedback to a user that the enclosure cover is fully closed and secured to the enclosure base to ensure migration of bed bugs and the like is contained or obstructed by the enclosure.

For some embodiments, the zipper enclosure may include a feedback arrangement that produces an audible and/or tactile signal or feedback that notifies a user that the enclosure cover is fully closed to contain or obstruct migration of bed bugs and the like through the enclosure. For example, feedback may be provided by a snap-fit or press-fit arrangement situated at a suitable region of the enclosure cover and/or the enclosure base. Accordingly, once the cover is completely closed on the enclosure base and the zipper chain is fully engaged by the channel barriers so as to form a suitable obstruction, an audible clicking sound can be produced that is heard by the user, informing the user that the zipper enclosure is appropriately and sufficiently closed. Alternatively, if the nature of the engagement does not produce an audible sound, a user may be able to feel through a tactile sensation (e.g., via an interference fit) that suitable engagement between the enclosure cover and the enclosure base has been established.

In one embodiment, the channels 232 and the protrusions 234 may be configured to provide tactile and/or an audible feedback as an indication that the cover is fully closed and secured to the enclosure base to contain or obstruct migration of bed bugs and the like through the zipper enclosure. However, it is to be understood that the enclosure may employ any suitable feedback arrangement as should be apparent to one of skill in the art.

To facilitate opening the enclosure cover from the enclosure base, a pair of tabs 236, 238 may be provided on the cover and the enclosure base. As illustrated, the tabs may extend from the sides of the cover 204 and the base 202 opposite the hinge 206 and be arranged so that they are offset from each other when the cover is closed and secured to the enclosure base. In this manner, the cover may be opened by exerting opposing forces on the cover tab 238 and the base tab 236 to pull the cover open and away from the enclosure base.

Figure 7:
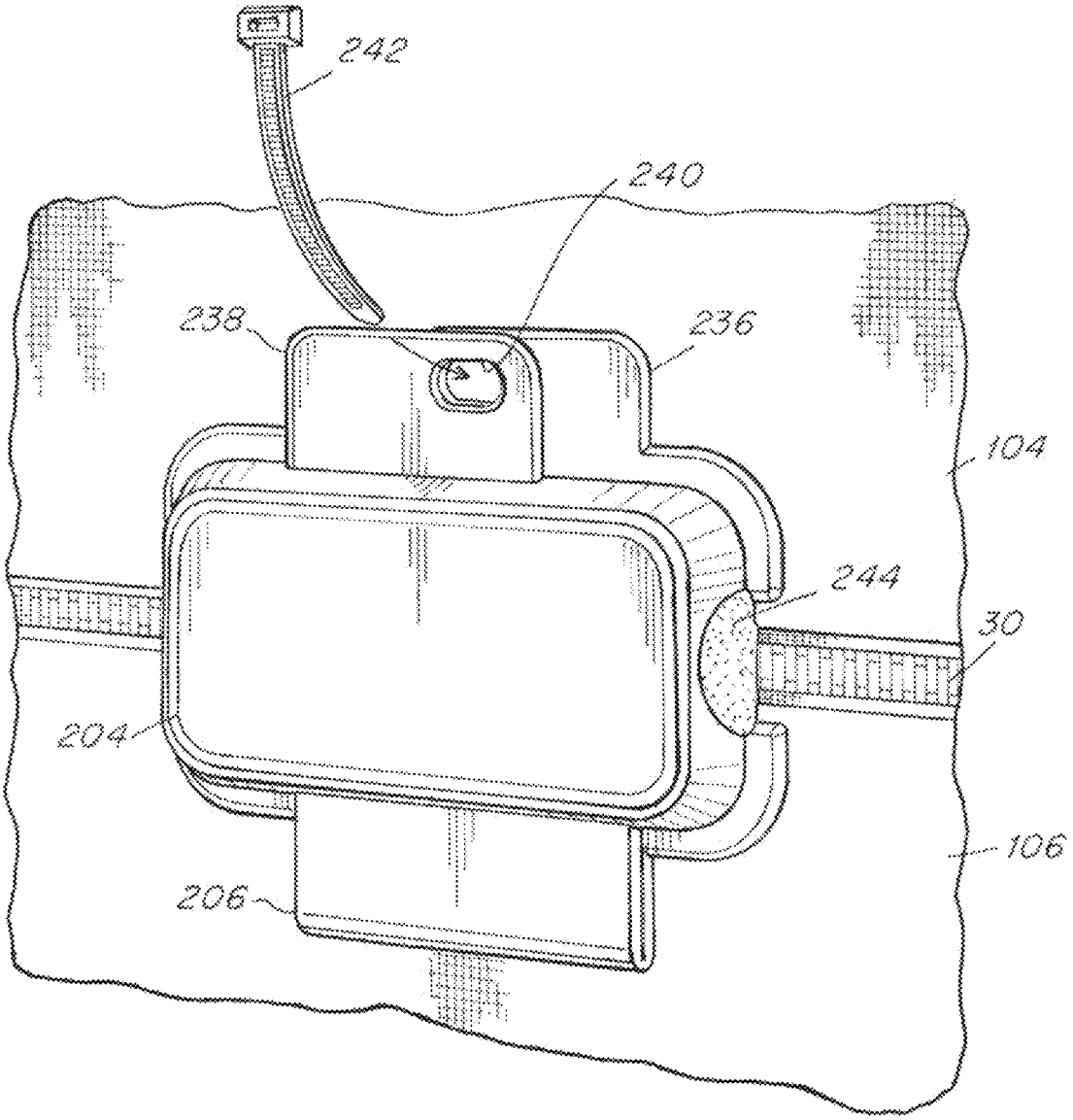
FIG. 7 illustrates the cover of the zipper enclosure of FIG. 3 placed in a closed position to enclose the slider head and pull tab of the zipper.
Figure 8:
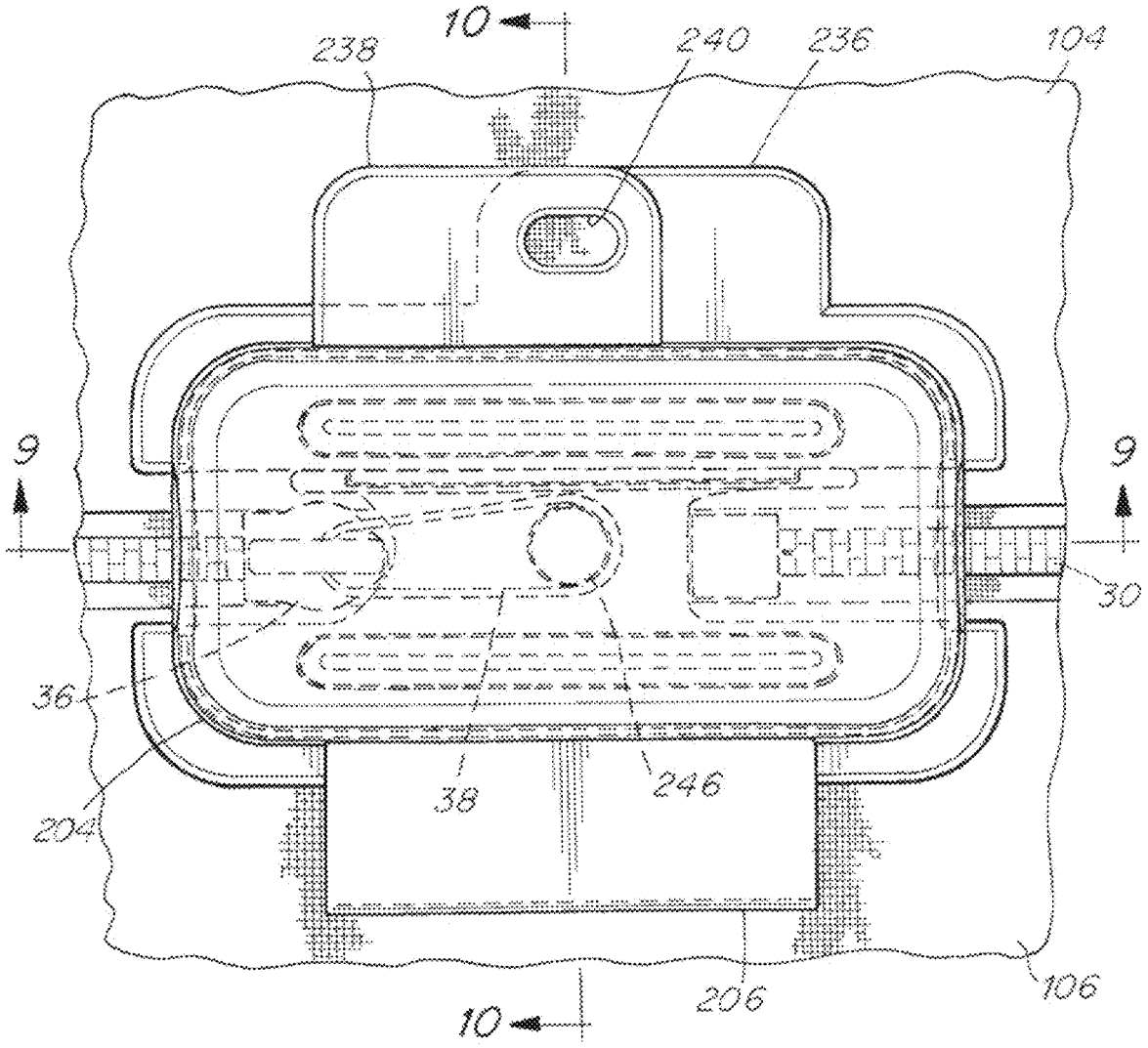
FIG. 8 is a front view of the closed zipper enclosure of FIG. 7.
Figure 9:
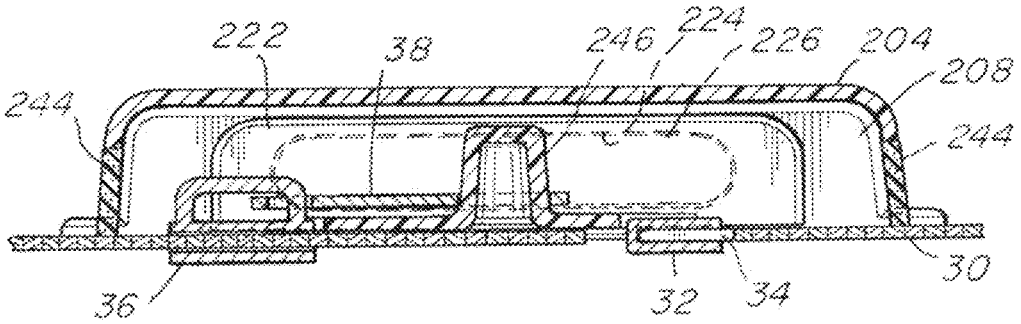
FIG. 9 is a cross-sectional view of the zipper enclosure taken along section line 9-9 of FIG. 8.

In some instances, it may be desirable to lock the cover to the enclosure base. In one embodiment, the tabs 236, 238 may be provided with openings 240 that align with each other when the cover is closed on the enclosure base. As shown in FIG. 7, a locking fastener 242, such as a cable tie, a strap, a lock and the like, may be passed through the aligned openings 240 and fastened or otherwise locked to secure the cover in the closed position. Thereafter, the locking fastener may be cut or otherwise unlocked to remove it so that the cover may be opened to access and open the zipper for removing the top cover panel from the mattress.

The enclosure cover and/or enclosure base may include one or more features to form one or more barriers that obstruct and contain any small particles and/or organisms, such as bed bugs, from migrating out of the mattress cover through the zipper. In one embodiment, the peripheral channels 232 and protrusions 234 for securing the cover 204 to the enclosure base 202 may be configured to fit together tightly to obstruct passage of bed bugs and the like across the interface between these features. However, as described above, a base channel 218 (FIG. 5) is provided between and along the length of the first and second base portions 208, 210 for accommodating the zipper chain.

A pair of channel barriers 244 may be located at opposite ends of the cover 204 to obstruct migration of bed bugs and the like through the ends of the base channel. The channel barriers 244 may be configured to bridge at least the width of the base channel 218 and locally engage the zipper chain 30 when the cover is closed on the enclosure base, as shown in FIG. 7. The channel barriers 244 may be configured to protrude below the bottom edge of the cover and conform to the shape of the zipper chain 30 as the channel barriers 244 are pressed into engagement with the chain and portions of the cover panel located adjacent the chain. The length of the channel barriers may be selected to provide sufficient engagement along the length of chain to ensure obstruction of pathways between the cover and the chain.

The channel barriers may be formed of a resilient material with a suitable amount of flexibility and/or compressibility that conforms to various shapes of zipper chains after repeated openings and closing of the cover. In one embodiment, the channel barriers may be formed from a thermoplastic elastomer (TPE) or a thermoplastic rubber (TPR), or similar materials, such as silicone, as should be apparent to one of skill in the art. In one embodiment, the barrier materials may have a Shore A hardness of 15-20.

The enclosure base 202 may be provided with a retainer to engage the pull tab and hold the slider head in position relative to the enclosure base. In one illustrative embodiment shown in FIG. 3, the retainer 246 may include a post that is configured to pass through the opening at the end of the pull tab 38. The post 246 may protrude from the support 220 to extend into the base channel 218 between the first and second base portions. In one embodiment, the post 246 may have a cylindrical configuration, although other configurations for engaging the pull tab are contemplated. To facilitate engagement with the pull tab 38, the retainer 246 may have a tapered shape that narrows in a direction from the support 220 toward the free end of the post.

Figure 3:
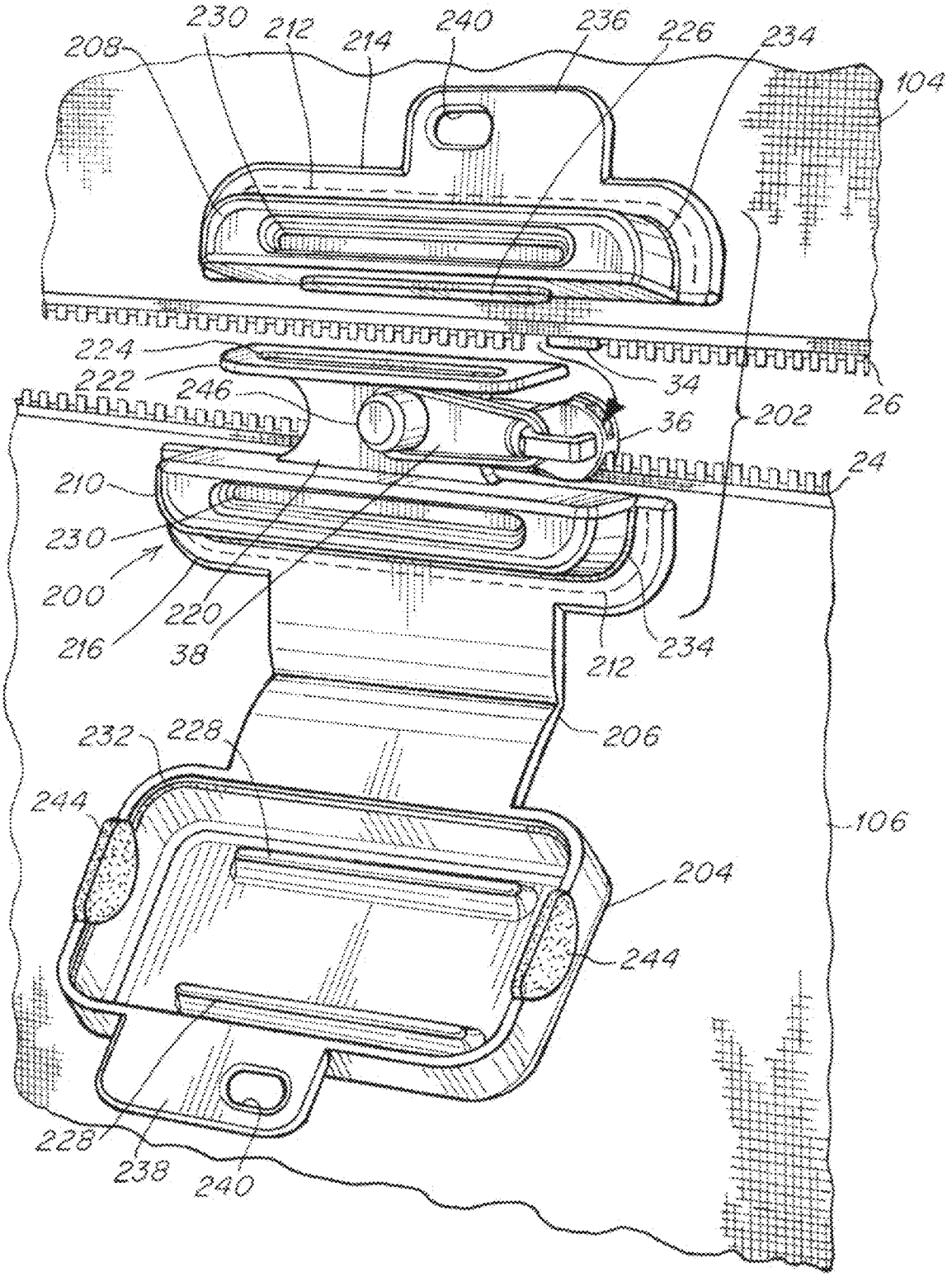
FIG. 3 is a perspective view of a zipper enclosure illustrating portions of the enclosure separated and attached to top and bottom cover panels of the mattress cover in accordance with an illustrative embodiment.
Figure 6:
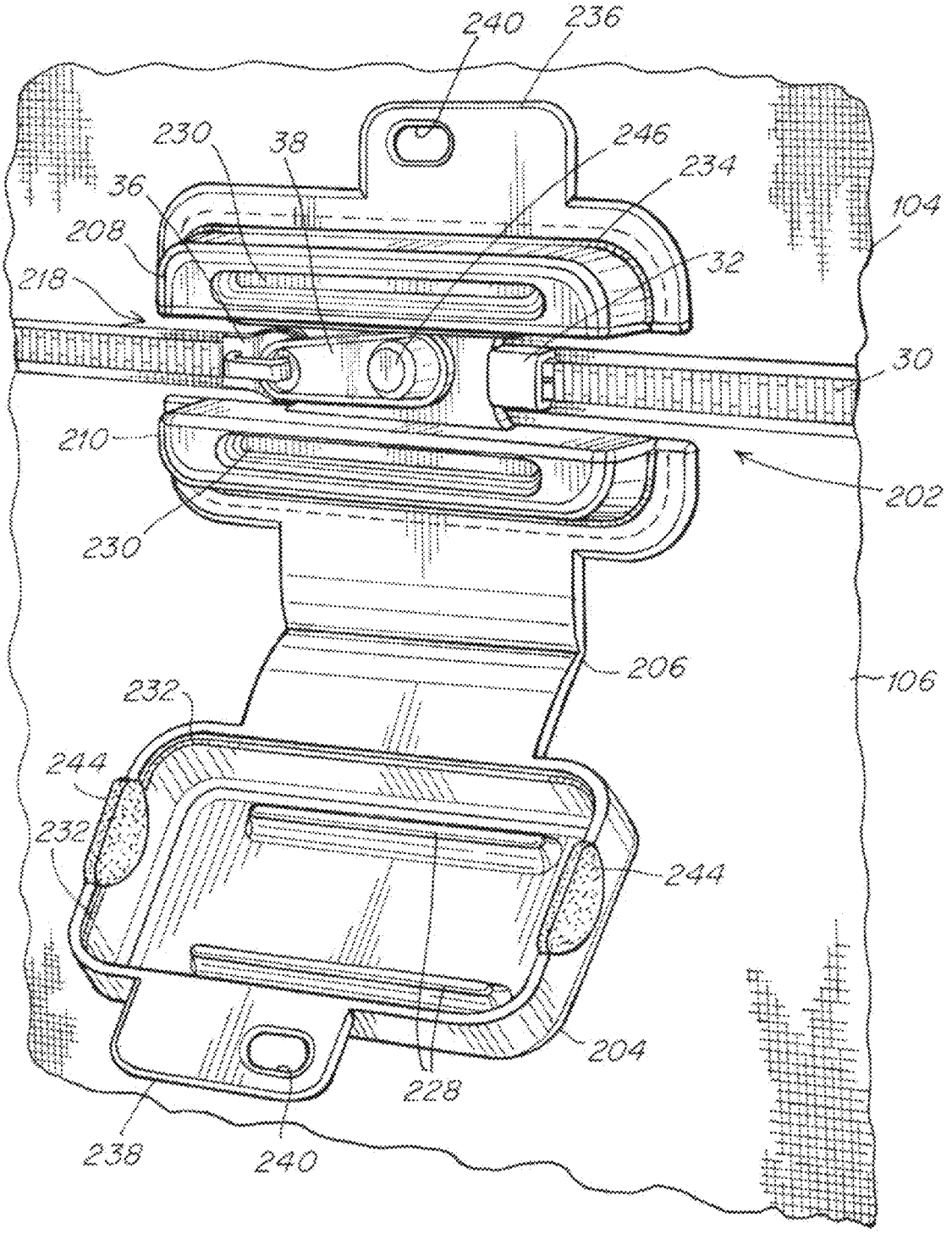
FIG. 6 illustrates the pull tab of the zipper engaged with a retainer of the zipper enclosure of FIG. 3.

The retainer may be located on the enclosure base to engage the pull tab 38 and retain the slider head 36 in a desired position at one or both ends of the enclosure base. As shown in FIG. 3, the retainer 246 may be positioned on the support to engage the pull tab 38 when the slider head 36 is positioned against the retainer box 32 of the zipper at a first end of the base channel 218. In this manner, the insertion pin 34 of the zipper may be inserted through the slider head 36 and into the retainer box 32 without requiring an individual to physically hold the slider head in position. When the zipper is fully closed, as shown in FIG. 6, the pull tab 38 may engage the retainer 246 when the slider head 36 is positioned at a second end of the base channel to close the zipper. In this manner, the slider head 36 is retained in a closed position so that it does not inadvertently move from the enclosure and open the zipper.

With the zipper closed and the slider head 36 positioned in the second end of the base channel 218, the cover 204 may be closed onto the enclosure base, as illustrated in FIGS. 7-10, to secure the first and second base portions to each other and enclose the slider head, the retainer box and portions of the zipper chain. Moreover, the peripheral channels/protrusions 232, 234 on the cover 204 and the enclosure base 202 snap together to secure the cover on the base and form a barrier along the periphery of the cover; in this manner, the channels/protrusions 232, 234 are described both as "fasteners" to secure the cover to the base and "barriers" to obstruct migration of bed bugs and the like. Additionally, the channel barriers 244 are pressed into engagement with the zipper chain 30 to obstruct the ends of the base channel. Consequently, any potential migration of small particles and organisms, such as bed bugs, from a mattress 102 through openings in the zipper 20 of the mattress cover 100 in the vicinity of the slider head 36 and/or the retainer box 32 are contained within the enclosure.

The zipper enclosure may be repeatedly washed and dried in the ordinary course of use. Thus, it may be desirable to form the zipper enclosure of suitable materials, such as a polymer or other material, which can be subject to washing and drying, repeated opening and closing of the hinge, etc. without damage.

In one embodiment, the zipper enclosure 200, including the first and second base portions 208, 210 and the cover 204, may be molded from a plastic material, such as polypropylene. The enclosure may employ, without limitation, transparent material for the cover 204 and/or the enclosure base 202 to allow visual inspection of the interior of the enclosure for the presence of bed bugs and other organisms, as well as to ensure proper positioning of the slider head 36 and pull tab 38 of the zipper. The enclosure components may be molded, such as injection molding, although other fabricating processes may be used as should be apparent to one of skill in the art.

In one embodiment, the channel barriers 244 may be overmolded onto the cover 204 of the enclosure. However, any suitable processes, including bonding, welding and the like, may be utilized to join the channel barriers to the cover, as should be apparent to one of skill in the art.

To enhance visual inspection of the slider head 36 and pull tab 38 of the zipper through the enclosure cover, the pull tab may optionally be colored (e.g., bright green, red, blue, yellow) to provide a visual contrast with the enclosure that allows the inspector to easily see if the pull tab is properly positioned within the enclosure. For example, an inspector may have a need to quickly determine whether the zipper enclosure is appropriately installed for a large number of bedding encasements (or other appropriate articles). Using a transparent enclosure cover and a visually contrasting pull tab, an inspector can quickly peer through the cover and determine if the pull tab has been positioned to fully close the zipper.

Figure 11:
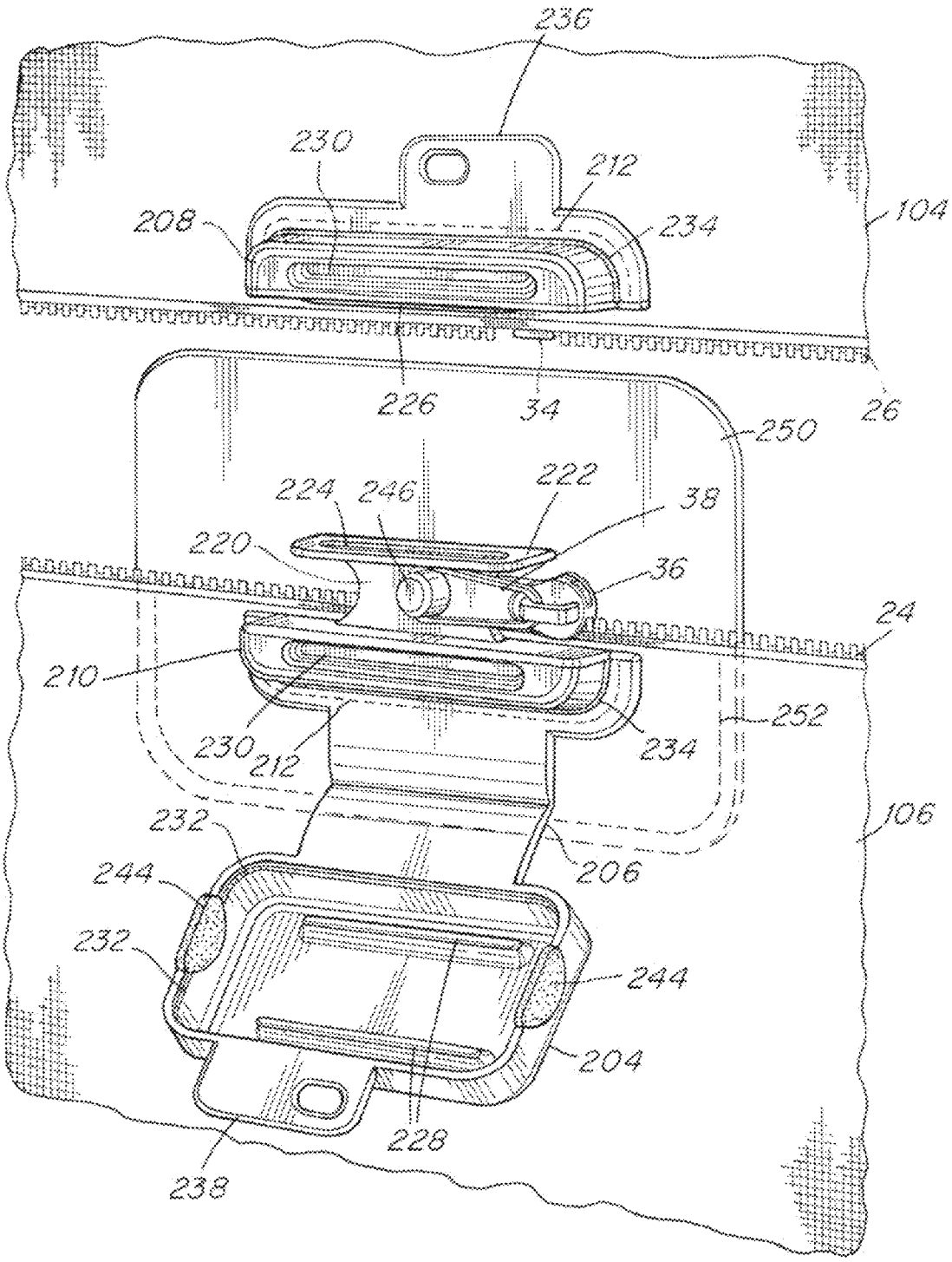
FIG. 11 is a perspective view of a zipper enclosure of FIGS. 2-10 with a backing panel to provide support in accordance with an illustrative embodiment.
Figure 12:
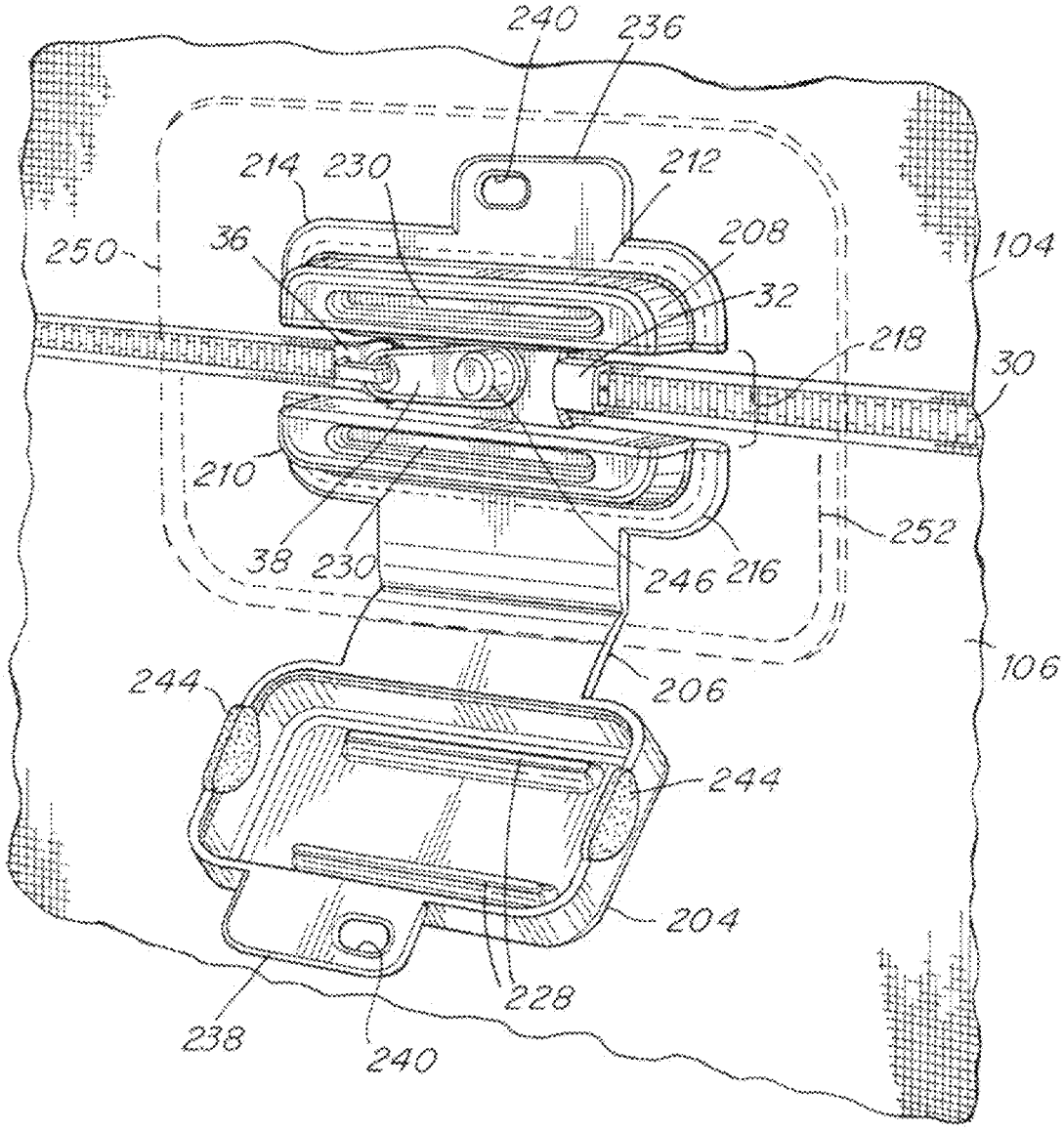
FIG. 12 illustrates the zipper closed to join the cover panels with the slider head positioned at a second end of the zipper enclosure of FIG. 11.

For some applications, it may be desirable to provide additional support between the zipper enclosure 200 and the mattress 102 to ensure that the first and second base portions and the cover may be readily engaged and secured together to enclose the zipper. In one illustrative embodiment as shown in FIGS. 11-12, a backing panel 250 may be attached to the inside of the bottom cover panel 106 opposite the second base portion 210. As shown, the backing panel 250 may be configured to extend above the bottom cover panel 106 so that it can also be positioned on the inside of the top cover panel 104 opposite the first base portion 208 when the top and bottom cover panels are joined together with the zipper. In one embodiment, the backing panel may be attached with a series of stitches 252, although the backing panel any be attached using any suitable technique as should be apparent to one of skill in the art.

The backing panel may be configured to provide a suitable amount of stiffness and flexibility as should be apparent to one of skill. In one embodiment, the backing panel may be formed from a plastic material, such as polypropylene or low density polyethylene (LDPE), that may be die cut and sewn to a fabric material. However, the backing panel may be formed from any suitable material as should be apparent to one of skill in the art.

Figure 21:
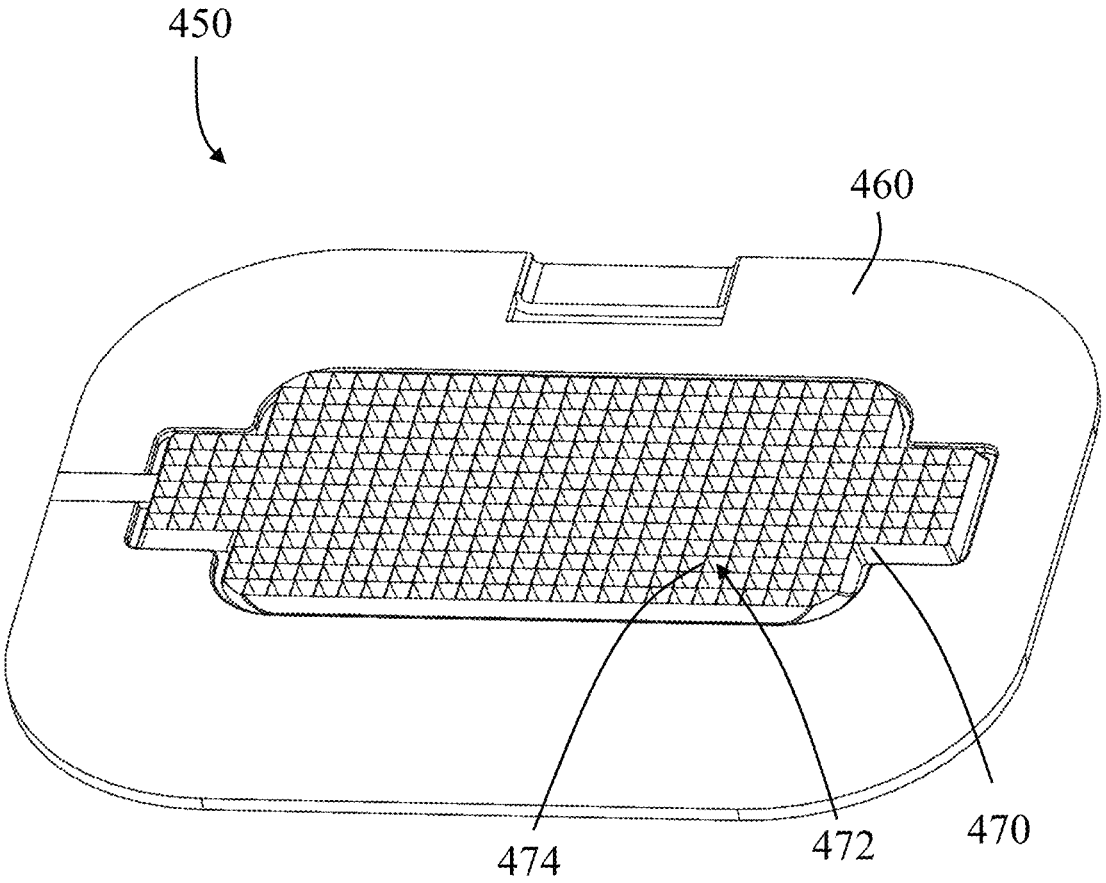
FIG. 21 is a perspective view of a backing panel in accordance with an illustrative embodiment.

In some embodiments, the backing panel may be configured with a barrier on an interior portion of a mattress cover for obstructing migration of bed bugs from the interior portion to the zipper enclosure. In one illustrative embodiment shown in FIG. 21, the backing panel 450 may include a panel body 460 and a barrier 470 provided in a central region of the panel body. As illustrated, the barrier 470 may include padding and may be provided in a recess in the panel body 460. Moreover, the barrier padding may include a plurality of open cells 472 separated by cross ribs 474 extending across the padding in opposite directions; such a structure may impart the barrier with a desired flexibility/compressibility. However, it should be appreciated that other barrier structures may be suitable (e.g., a solid padding, a contoured padding, etc.) as should be apparent to one of skill in the art.

In one embodiment, the barrier 470 may be formed from a thermoplastic elastomer (TPE), a thermoplastic rubber (TPR), or other suitable materials, such as silicone, as should be apparent to one of skill in the art. In one embodiment, the barrier material may have a Shore A hardness of 15-20. In some embodiments, the panel body 460 may be formed from a different material from the barrier padding 470. For example, the panel body may be formed from a material that is more rigid than the padding such as a plastic material (e.g., polypropylene or low density polyethylene (LDPE)). In this manner, the panel body may provide a desired rigidity to facilitate aligning and/or joining portions of a zipper enclosure, and the barrier may conform to irregular contours of the mattress cover (e.g., fabric, stitching, etc.) on an underside of the zipper to provide additional sealing. In some embodiments, the barrier 470 may be overmolded onto the panel body 460. However, any suitable processes, including bonding, welding and the like, may be utilized to join the barrier to the panel body, as should be apparent to one of skill in the art.

An illustrative method of enclosing the zipper of a mattress cover with a zipper enclosure is described in connection with FIGS. 3-7.

As shown in FIG. 3, the slider head 36 is positioned against the retainer box 32 adjacent a first end of the support 220 and the pull tab 38 is engaged with the retainer 246 to hold the slider head in position against the retainer box. This arrangement permits a user to insert the insertion pin 34 of the zipper on the top cover panel 104 into the slider head and the retainer box on the bottom cover panel 106 without needing to separately hold the slider head in position.

Figure 4:
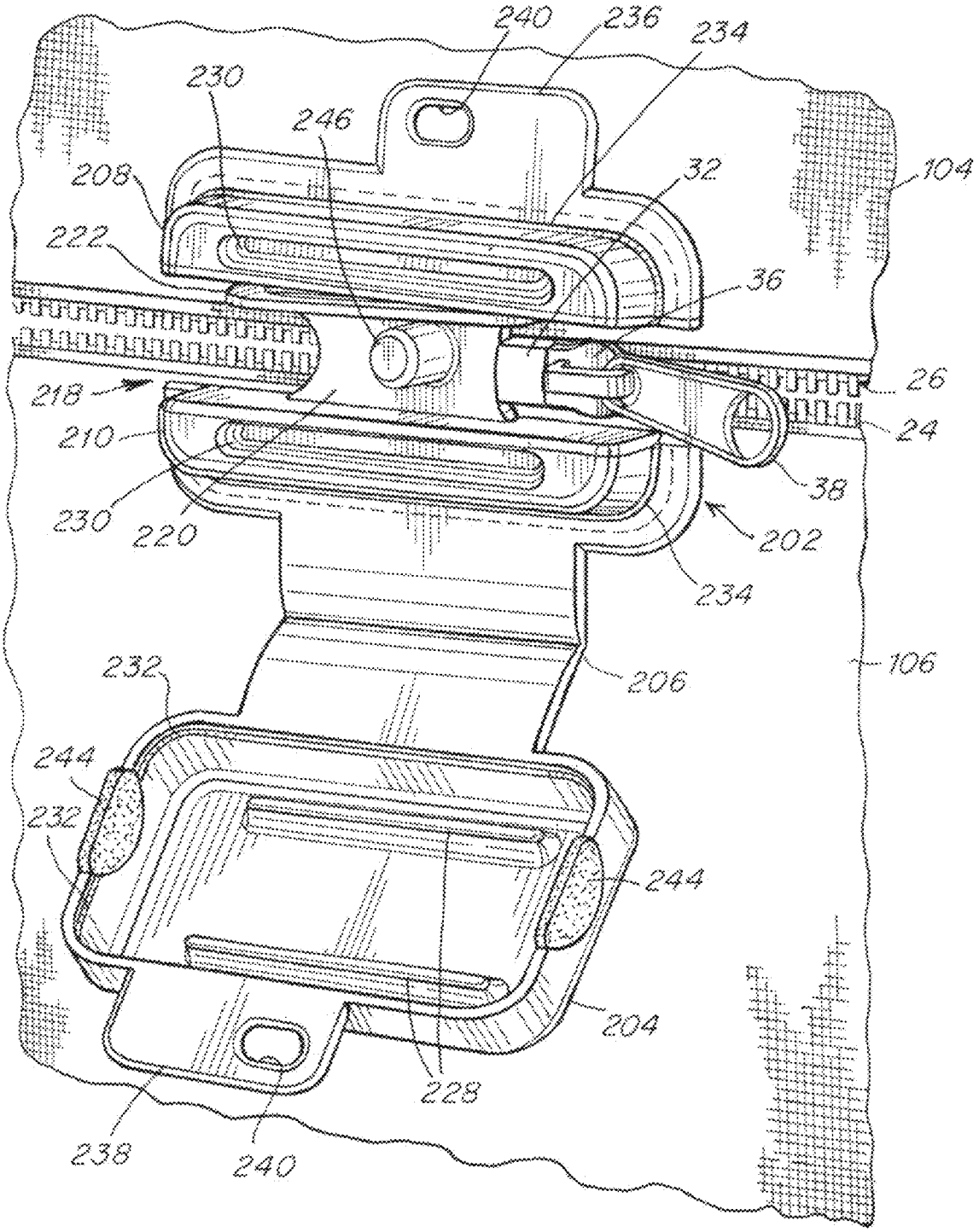
FIG. 4 illustrates the portions of the zipper enclosure of FIG. 3 engaged with each other where the slider head of the zipper of the mattress cover is positioned at a first end of the enclosure base for initiating closure of the zipper.

As shown in FIG. 4, with the insertion pin 34 of the zipper engaged in the retainer box 32, the pull tab 38 is disengaged from the retainer 246 to permit the user to pull the slider head 36 away from the retainer box and along the length of the zipper about the periphery of the mattress to close the zipper chain 30 and join the top and bottom cover panels 104, 106 to each other.

As shown in FIG. 5, the slider head 36 has been pulled along the length of the zipper and is positioned at a second end of the support 220 to fully close the zipper. Closing the zipper draws the first and second base portions 208, 210 of the enclosure base together with the support foot 222 engaging and aligning the first base portion 208 with the second base portion 210.

As shown in FIG. 6, the pull tab 38 is engaged with the retainer 246 to secure the slider head 36 in the closed position. In this manner, the incidence of the zipper opening due to inadvertent movement of the slider head may be minimized, if not prevented.

As shown in FIG. 7, with the slider head 36 and the pull tab 38 in the closed position, the enclosure cover 204 is closed on the enclosure base 202. The cover 204 is pushed onto the enclosure base until the fastener channels 232 along the inner periphery of the cover snap onto the protrusions 234 along the outer periphery of the enclosure base. With the cover fully closed on the enclosure base, the channel barriers 244 at each end of the cover are pushed into engagement with and conform to the shape of the portions of the zipper chain 30 extending below the ends of the cover to seal and provide barriers against migration of bed bugs and other small particles and organisms along the zipper chain. In this manner, any bed bugs that may migrate from a mattress through openings in the zipper chain may be contained within the enclosure. Thereafter, the cover 204 may be secured to the enclosure base 202 using a fastening device 242, such as a cable tie, to ensure that the enclosure remains closed until the fastening device is intentionally removed to gain access to the zipper components enclosed in the protective enclosure.

In another embodiment illustrated in FIGS. 13-20, a zipper enclosure 300 includes an enclosure base 302 that is attachable to the mattress cover 100 and an enclosure cover 304 that can be closed and opened relative to the base. The enclosure cover 304 may be coupled to the enclosure base 302 with a hinge 306 that permits the cover to be pivoted between opened and closed positions. In the depicted embodiment, the hinge 306 is a living hinge integrally formed with the enclosure base 302, although any suitable hinge arrangement may be used as should be apparent to one of skill in the art.

Similar to the embodiment described above, the base 302 is configured to receive one or more portions of the zipper, such as the retainer box 32, the slider head, 36, and the pull tab 38, which are thereafter enclosed when the cover 304 is closed on the base 302. The enclosure base and cover are configured to prevent migration of particles and/or organisms through the zipper enclosure when the cover is closed.

As illustrated in FIGS. 13-20, the enclosure base 302 includes a first base portion 308 and a separate second base portion 310 that are individually attachable to the top and bottom cover panels 104, 106 of the mattress cover. In some instances, the base portions 308, 310 may be sewn to the cover panels via a series of stitches 312 placed through a flange 314, 316 of each base portion. For example, the base portions 308, 310 may have holes (not depicted in the figures) through which a suitable thread or yarn may pass for attachment of the base portions to the cover panels. Although a stitched attachment has been depicted, it should be understood that the base portions may be attached to the cover panels using any suitable technique as should be apparent to one of skill in the art. For example, and without limitation, the base portions may be attached to the mattress cover panels using a suitable adhesive (e.g., resin, epoxy, glue, etc.), staples, or a hook and loop fastener arrangement.

Figure 13:
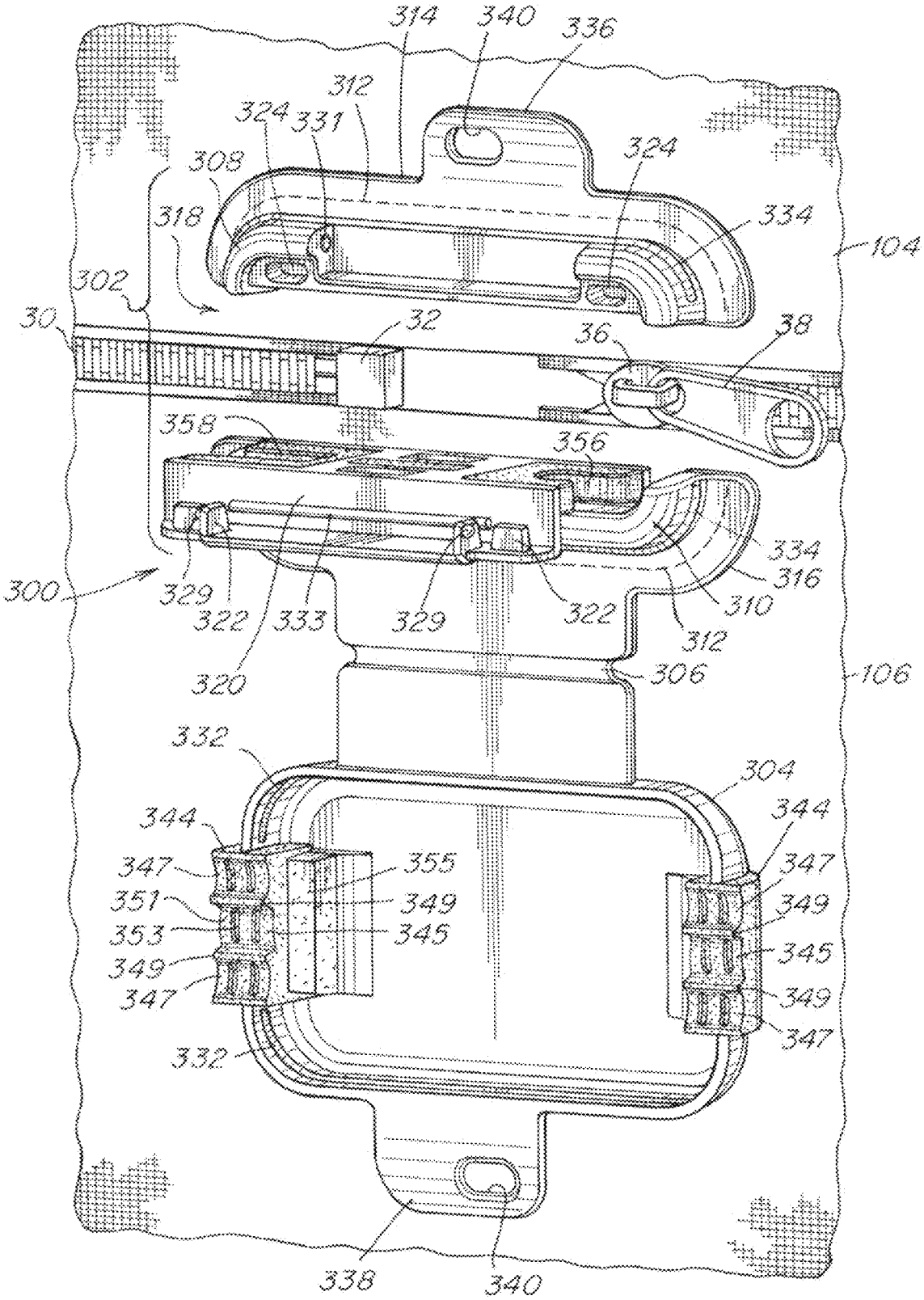
FIG. 13 is a perspective view of a zipper enclosure illustrating portions of the enclosure separated and attached to top and bottom cover panels of the mattress cover in accordance with an illustrative embodiment.
Figure 14:
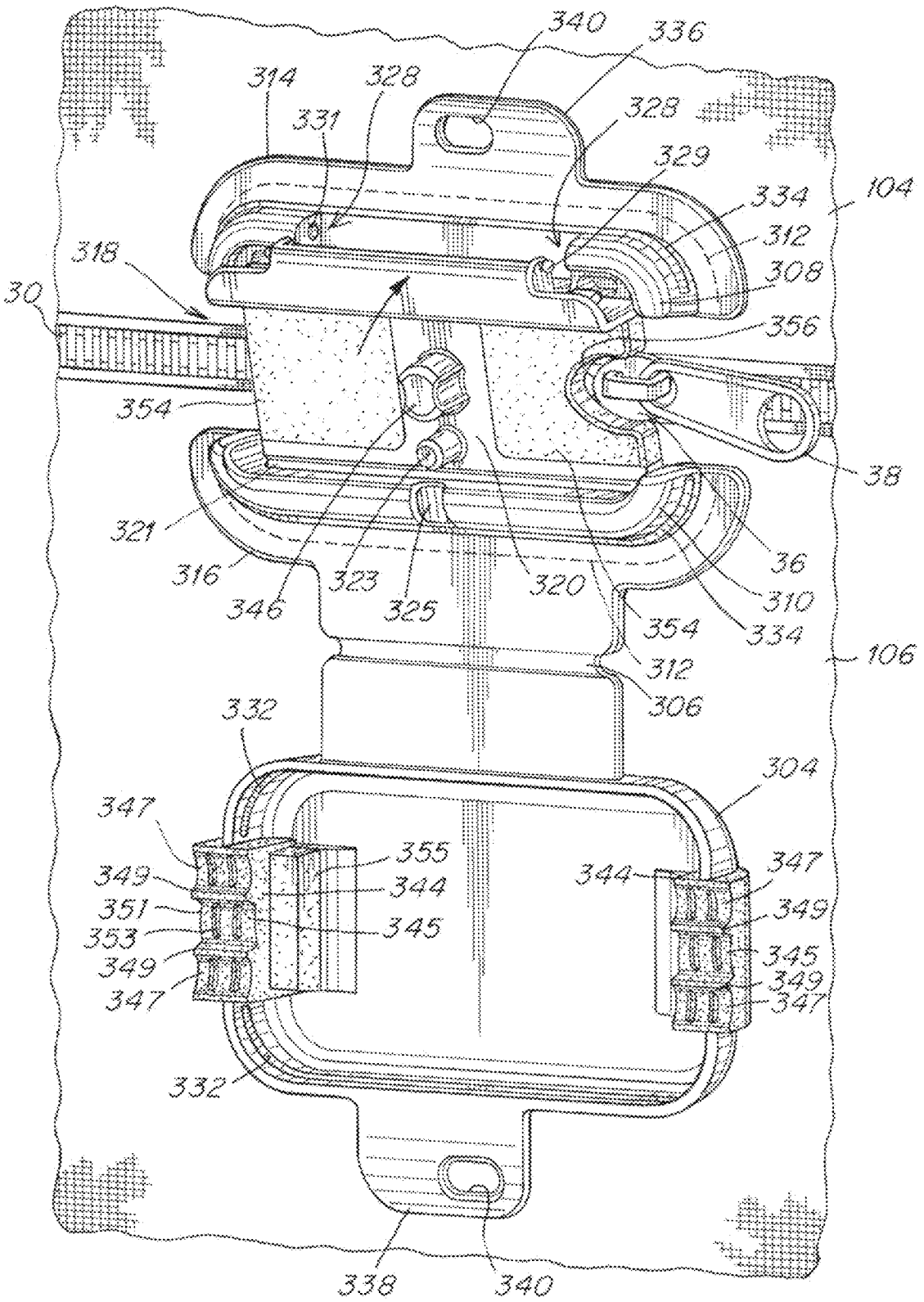
FIG. 14 illustrates the portions of the zipper enclosure of FIG. 13 in a configuration in which a support is moved from an open position towards a closed position.
Figure 15:
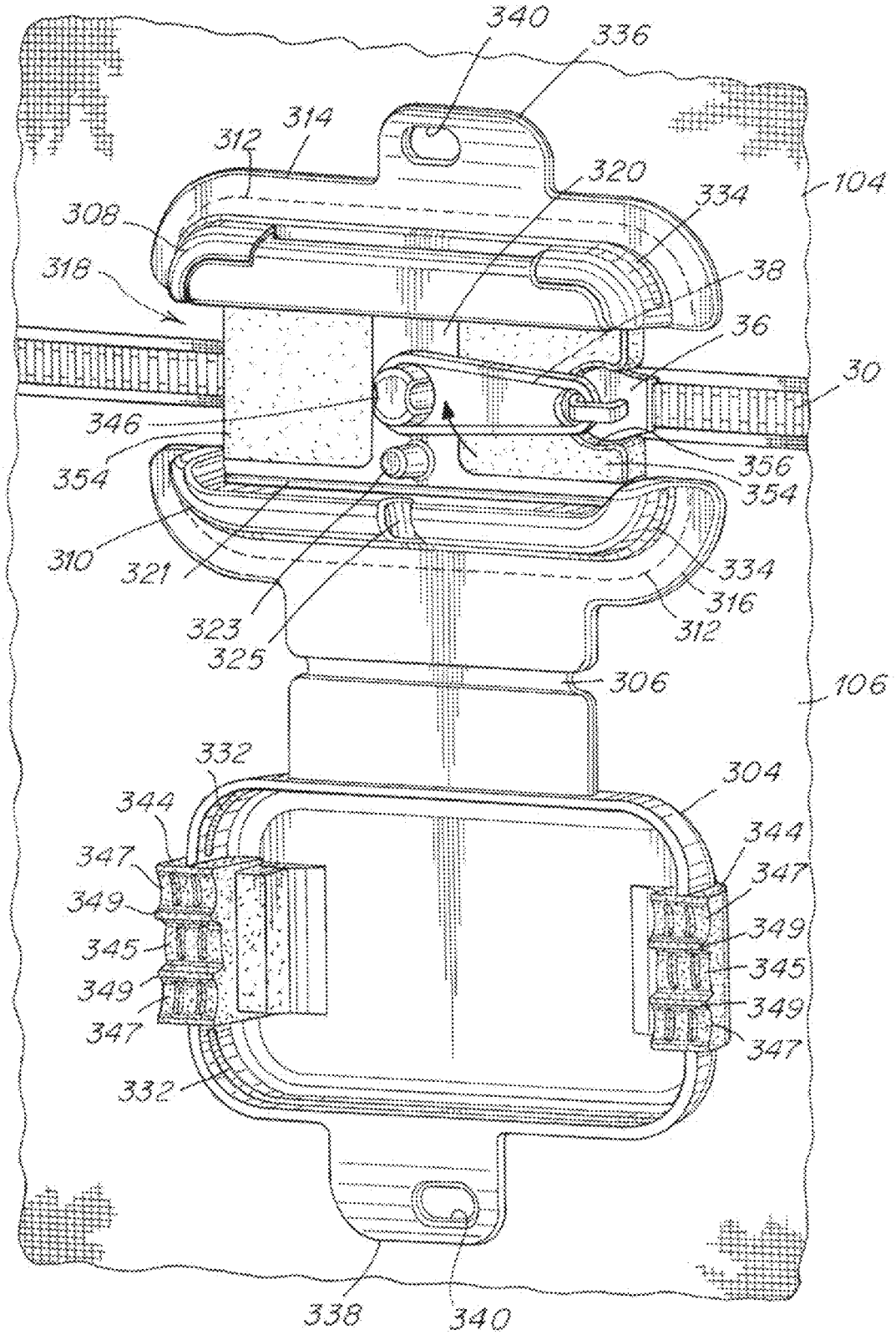
FIG. 15 illustrates the support in a closed position and the pull tab of the zipper engaged with a retainer of the zipper enclosure of FIG. 13.

The base portions 308, 310 may be arranged adjacent to the edges of the cover panels 104, 106 such that the zipper chain 30 can extend along the cover panels and between the base portions when the zipper is closed to join the cover panels and encase the mattress. As shown in FIGS. 13-15, a channel 318 may be formed along the length of the enclosure base 302 between the first and second base portions 308, 310 when the base portions are drawn into position adjacent each other as the zipper is closed to join the top and bottom cover panels. The enclosure base 302 may be configured to receive portions of the zipper, including the retainer box 32, the slider head 36, the pull tab 38, and segments of the zipper chain 30, within the channel 318.

As discussed previously, it may be desirable to provide one or more features for aligning, spacing, joining, and/or maintaining the position of the first and second base portions relative to each other. For example, in one embodiment, the enclosure base 302 may include a support 320 (e.g., a bridge) for spacing the first and second base portions 308, 310 at a selected distance from each other so as to establish a desired width for the channel 318 for receiving the various components of the zipper. As illustrated, the support 320 may be integrally formed as part of the second base portion 310 and may be configured to extend across and bridge the channel 318 and engage with the first base portion 308, though it should be understood that, if desired, the support may be formed as part of the first base portion and be configured to engage with the second base portion. Additionally, it should be understood that, if desired, the support may not be integrally formed with the first or second base portions, and may instead be provided as a separate component configured to couple to the first or second base portion via a suitable hinge arrangement.

In some applications, it may be desirable for the support 320 to be moveable relative to the enclosure base, as illustrated in FIGS. 13-15. For example, the support may be moveable between an open position (FIG. 13) and a closed position (FIG. 15). When in the open position, the support 320 may not extend across and bridge the channel 318, thereby leaving the channel open and not obstructed by the support. Such a configuration may be beneficial to facilitate joining of the zipper tracks, such as insertion of the insertion pin 34 into the slider head 36. When in the closed position, the support 320 may extend across the channel 318 and engage with the first base portion 308. The support 320 may be coupled to the second base portion 310 via a hinge 321, which permits the support to move between the open and closed positions. In the depicted embodiment, the hinge 321 is a living hinge integrally formed with the second base portion 310, although it should be understood that any suitable hinge arrangement may be used as should be apparent to one of skill in the art.

In some embodiments, the support 320 and/or enclosure base 302 may include one or more features to aid in maintaining the support in the open position. For example, as illustrated in FIGS. 14-15, the support may include an engaging member such as a post 323 configured to engage a corresponding recess 325 formed on the second base portion 310. When the support 320 is moved to the open position, the post 323 may interlock with the recess 325 to hold the support in place in the open position. Although a post and recess arrangement is shown in the figures, it should be understood that other interlocking arrangements also may be suitable. For example, and without limitation, the support 320 and enclosure base 302 may include a suitable latching arrangement, a hook and loop fastener arrangement, an adhesive pad on the support and/or enclosure base, or any other suitable arrangement as should be apparent to one of skill in the art to maintain the support in a desired position. Alternatively, the enclosure 300 may not include any feature to maintain the support in the open position (or in any other position between the open position and the closed position), as the current disclosure is not limited in this regard.

As discussed previously, in some embodiments, one or more features may be provided to facilitate alignment of the first and second base portions 308, 310 as they are drawn together and into engagement with each other. In the embodiment depicted in FIGS. 13-20, the support 320 may include protrusions 322 configured to engage with recesses 324 provided in the first base portion 308. As shown, the support 320 includes two protrusions located at opposite ends of the support 320 which engage with two corresponding recesses 324 on the first base portion. However, it should be understood that any suitable number of protrusions and/or recesses may be used and the protrusions and recesses may have any suitable shape and/or configuration as should be apparent to one of skill in the art for providing support between the base portions.

In some applications, it may be desirable to provide one or more features to secure the first and second base portions 308, 310 to one another. In one illustrative embodiment shown in FIGS. 13-20, the support 320 may include one or more detents 328 to secure the support to the first base portion 308, thereby securing together the first and second base portions. As illustrated, each detent 328 may include a bump 329 on the support which engages a corresponding depression 331 provided on the first base portion 308. Alternatively, the first and second base portions 308, 310 may be secured to one another without the use of detents or other similar features. For example, in some embodiments, the protrusions 322 and recesses 324 for aligning the base portions may be sized and/or shaped to form an interference fit to secure the support 320 to the first base portion 308. Alternatively or additionally, in some embodiments, the support 320 may include a protrusion such as a rib 333 extending along a portion of the support and configured to engage a corresponding channel 335 (FIG. 19) provided on the first base portion 308 and secure the support to the first base portion. Accordingly, it should be understood that the securing features may employ any suitable arrangement as should be apparent to one of skill in the art, as the current disclosure is not limited in this regard.

For some embodiments, the support and enclosure base may include a feedback arrangement that produces an audible and/or tactile signal or feedback that notifies a user that the support is fully engaged with the enclosure base. For example, the feedback may be provided by a snap-fit or press-fit arrangement situated at a suitable region of the support and/or the enclosure base. Accordingly, when the support is moved to the closed position and fully engaged with the enclosure base, an audible clicking sound can be produced that is heard by the user, informing the user that the support and enclosure base are sufficiently engaged and secured together. Alternatively, if the nature of the engagement does not produce an audible sound, a user may be able to feel through a tactile sensation (e.g., via an interference fit) that suitable engagement between the support and the enclosure base has been established.

In one embodiment, the detents 328 on the support 320 may be configured to provide tactile and/or audible feedback as indication that the support is fully engaged with the first base portion 308 when the support is moved to the closed position. Alternatively or additionally, in some embodiments, the rib 333 and channel 335 may be configured to provide tactile and/or audible feedback when the support is moved to the closed position and engaged with the first base portion. Accordingly, it is to be understood that the support and enclosure base may employ any suitable feedback arrangement as should be apparent to one of skill in the art.

Similar to the embodiments discussed above, the enclosure cover 304 and/or the enclosure base 302 may include one or more fasteners to facilitate securement of the cover to the base. In one embodiment, one or more channels 332 may extend about the inner periphery adjacent the open end of the cover 304, and one or more protrusions 334 may extend about the outer periphery adjacent the flange 314, 316 of each base portion 308, 310. The channels 332 and the protrusions 334 may be configured to engage with each other in a manner that secures the cover to the enclosure base. For example, the channels and protrusions may be configured so that the channels 332 snap onto and grip the protrusions 334 when the enclosure cover 304 is closed to secure the cover on the enclosure base 302.

As discussed previously, it may be desirable to provide feedback to a user that the enclosure cover is fully closed and secured to the enclosure base to ensure migration of bed bugs and the like is contained or obstructed by the enclosure. Accordingly, similar to the embodiments described previously, the channels 332 and protrusions 334 may be configured to provide tactile and/or audible feedback as an indication that the cover is fully closed and secured to the enclosure base to contain or obstruct migration of bed bugs and the like. However, it should be understood that the enclosure 302 may employ any suitable feedback arrangement as should be apparent to one of skill in the art.

To facilitate opening the enclosure cover 304 from the enclosure base 302, a pair of tabs 336, 338 may be provided on the cover and the enclosure base, respectively. As illustrated, the tabs may extend from the sides of cover 304 and base 302 opposite the hinge 306 and be arranged so that they are offset from each other when the cover is closed and secured to the enclosure base. In this manner, the cover may be opened by exerting opposing forces on the cover tab 338 and the base tab 336 to pull the cover open and away from the enclosure base.

As discussed previously, in some instances, it may be desirable to lock the cover to the enclosure base. Similar to the embodiments described above, the tabs 336, 338 may be provided with openings 340 that align with each other when the cover 304 is closed on the enclosure base 302. A locking fastener (not depicted), such as a cable tie, a strap, a lock and the like, may be passed through the aligned openings 340 and fastened or otherwise locked to secure the cover in the closed position. Thereafter, the locking fastener may be cut or otherwise unlocked to remove it so that the cover ay be opened to access and open the zipper for removing the top cover panel from the mattress.

As discussed previously, the enclosure cover and/or enclosure base may include one or more features to form one or more barriers that obstruct and contain any small particles and/or organisms, such as bed bugs, from migrating out of the mattress cover through the zipper. In one embodiment, the channels 332 and the protrusions 334 for securing the cover 304 to the enclosure base 302 may be configured to fit together snugly to obstruct passage of bed bugs and the like across the interface between these features. However, a base channel 318 is provided between and along the length of the first and second base portions 308, 310 for accommodating the zipper chain.

Figure 16:
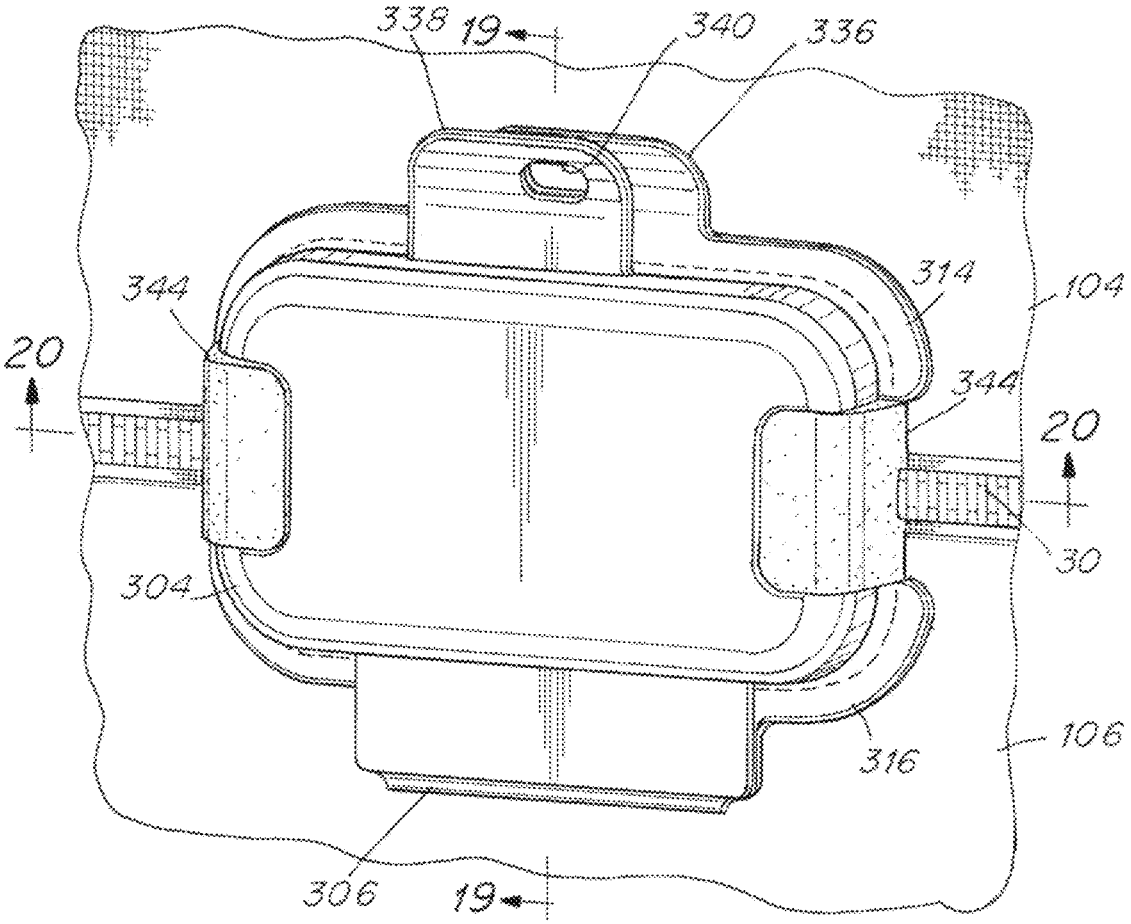
FIG. 16 illustrates the cover of the zipper enclosure of FIG. 13 placed in a closed position to enclose the slider head and pull tab of the zipper.
Figure 17:
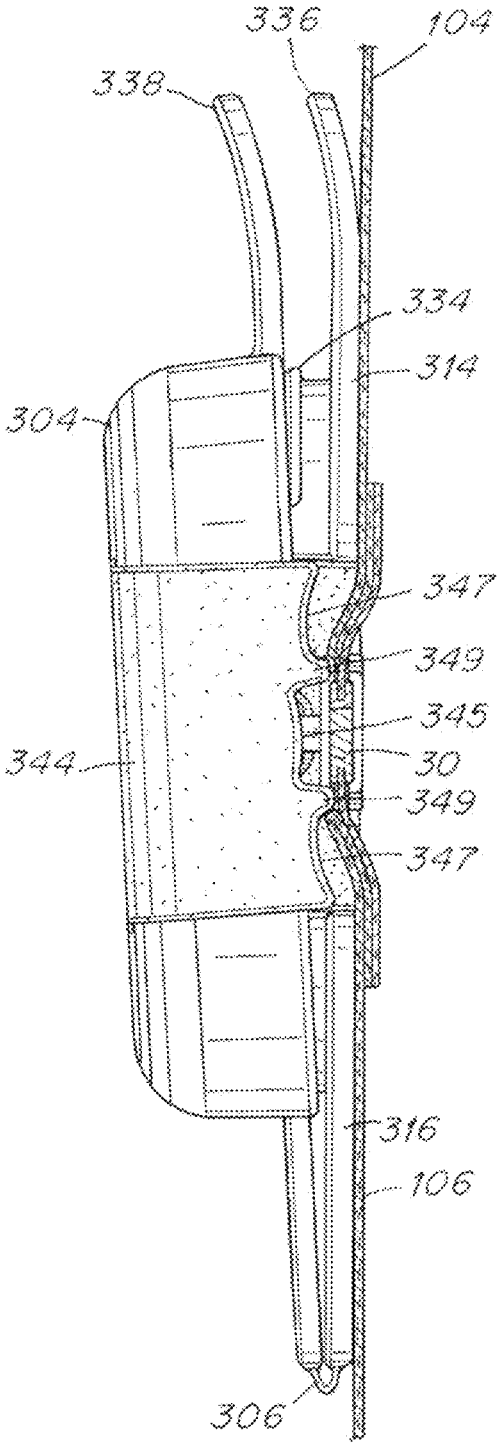
FIG. 17 is a side view of the zipper enclosure of FIG. 13 and illustrates a channel barrier overlying portions of the zipper chain.
Figure 18:
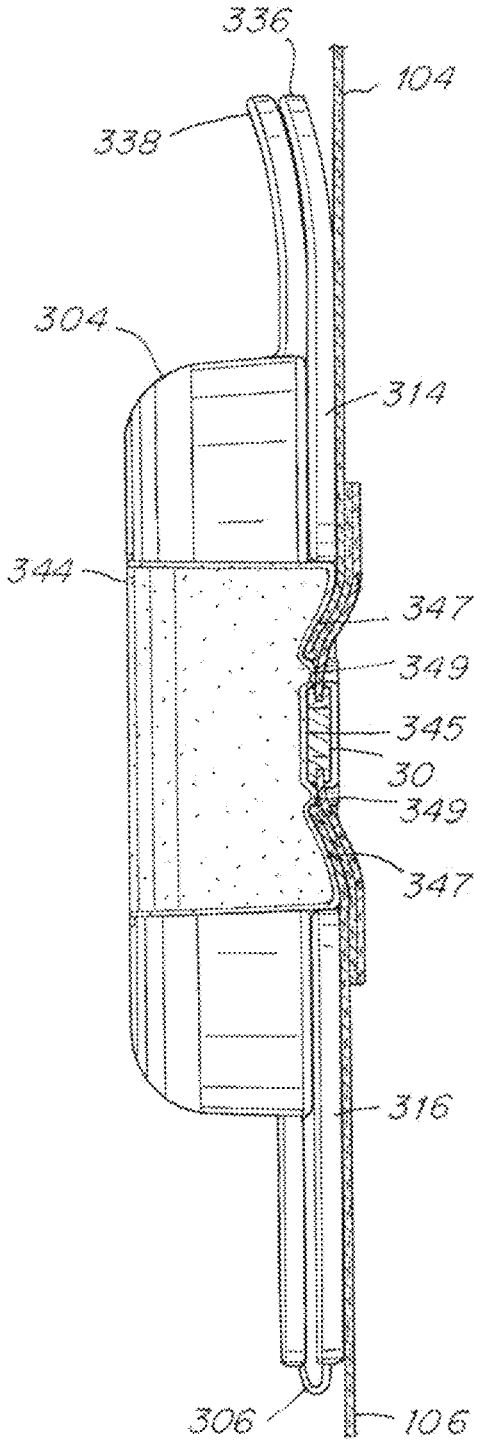
FIG. 18 illustrates the channel barrier of FIG. 17 engaged with the zipper chain when the cover is in the closed position.
Figure 19:
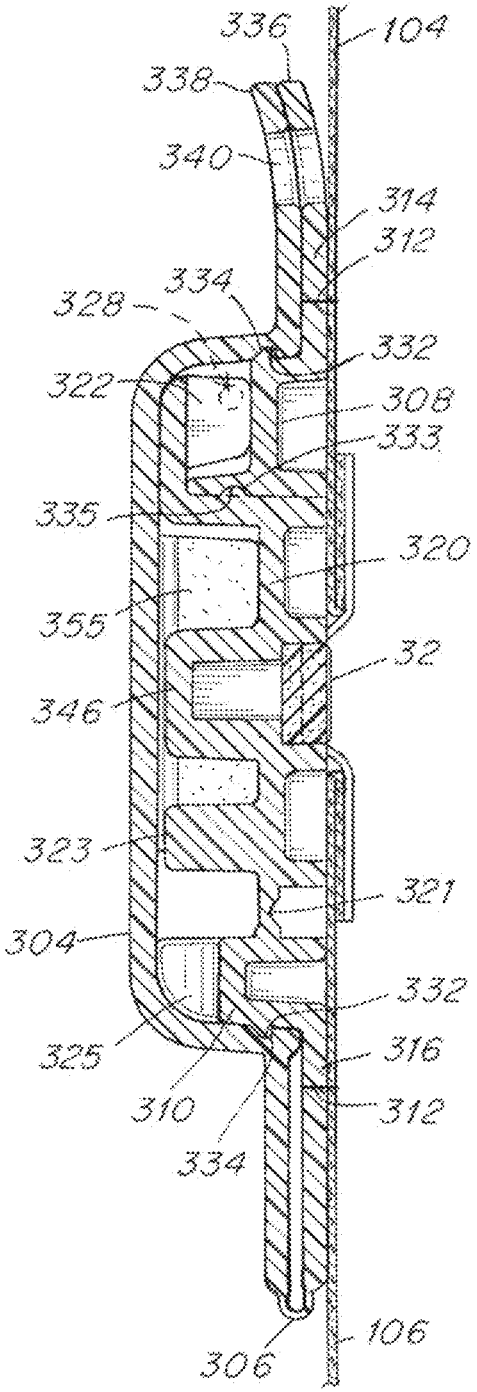
FIG. 19 is a cross-sectional view of the zipper enclosure taken along section line 19-19 of FIG. 16.
Figure 20:
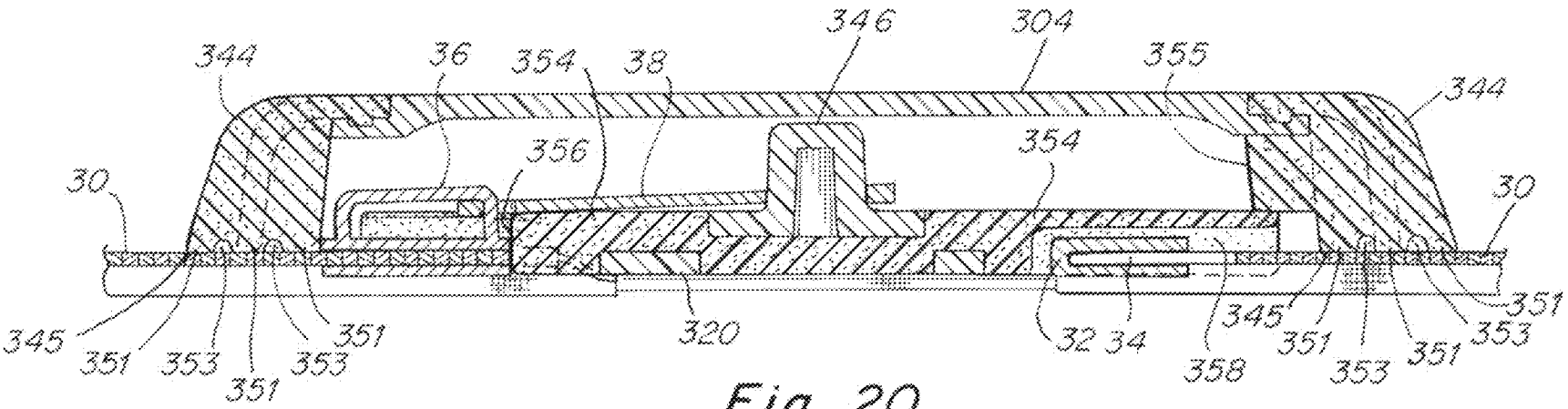
FIG. 20 is a cross-sectional view of the zipper enclosure taken along section line 20-20 of FIG. 16.

A pair of channel barriers 344 may be located at opposite ends of the cover 304 to obstruct migration of bed bugs and the like through the ends of the base channel 318. The channel barriers 344 may be configured to bridge at least the width of the base channel 318 and locally engage the zipper chain 30 when the cover is closed on the enclosure base, as shown in FIGS. 16-18. The channel barriers 344 may be configured to protrude below the bottom edge of the cover 304 and conform to the shape of the zipper chain 30 as the channel barriers 344 are pressed into engagement with the chain and portions of the cover panels located adjacent the chain. The length of the channel barriers may be selected to provide sufficient engagement along the length of the chain to ensure obstruction of pathways between the cover and the chain.

For some applications, it may be desirable to provide channel barriers that are pre-shaped and/or contoured to substantially match a three dimensional profile of the zipper tracks and/or portions of the cover panels when the zipper is closed. For example, each channel barrier may be pre-shaped to have one or more portions configured to engage with different portions of the zipper chain and/or cover panels. In one illustrative embodiment, each channel barrier 344 may include a zipper chain engaging portion 345 located at a central portion of the channel barrier that is configured to overlie and engage the zipper chain 30 when the cover 304 is closed on the enclosure base 302. Each channel barrier may also include a pair of hem engaging portions 347 located on opposite sides of the zipper chain engaging portion 345 and configured to overlie and engage hems 31 where the zipper chain is attached to the cover panels. Additionally, the channel barriers may include one or more protrusions 349 positioned between the hem engaging portions 347 and the zipper chain engaging portion 345. The protrusions may be configured to engage with a portion of depressions (e.g., trenches or channels) which may be located along the length of the zipper between the hems and the zipper chain.

As illustrated in FIGS. 13-14, each engaging portion of the channel barriers 344 may include one or more barrier segments 351 separated by recesses 353. Each barrier segment and/or recess 351, 353 may be configured to extend in a direction generally across the zipper chain 30. In some instances, each barrier segment may deform or compress independently from other adjacent barrier segments when the barrier portions are brought into engagement with the zipper tracks. As a result, each barrier segment 351 may provide a separate contact surface to facilitate sealing of the zipper enclosure and obstruct migration of bed bugs and the like. Moreover, in some instances, the recesses 353 may impart additional flexibility/compressibility to the barrier portions to facilitate the formation of a seal when the barrier portions are engaged with the zipper.

As discussed above, each channel barrier 344 may include pre-shaped and/or contoured engaging portions, such as a zipper chain engaging portion 345 and/or hem engaging portions 347, and each engaging portion may have a pre-formed curved shape. For instance, as illustrated in FIG. 17, each zipper chain engaging portion 345 may have a convex curvature, and each hem engaging portion 347 may have a concave curvature. Additionally, it should be understood that the different engaging portions may have any suitable curvature or other pre-formed shape. For example, the engaging portions may have the same curvature (e.g., all convex or concave), different curvatures, or other pre-formed shapes such as a wavy contour, as the current disclosure is not limited in this regard.

Moreover, although the channel barriers, including the pre-shaped/contoured channel barriers 344, have been depicted and described in connection with a zipper enclosure including first and second base portions formed separately from one another, it should be understood that the current disclosure is not limited in this regard. For example, the pre-shaped barrier may be used with any suitable enclosure structure, including a one piece enclosure base.

In some embodiments, the support 320 may include a support barrier 354 configured to overlie and/or engage with one or more portions of the zipper when the support is in the closed position. In one embodiment shown in FIGS. 13-15, the support barrier may include a slider engaging portion 356 located at a first end of the support and configured to engage with the zipper slider 36. As illustrated in FIG. 13, the slider engaging portion 356 may be include a recess configured to receive the zipper slider. Additionally, the support barrier may include a retainer box engaging portion 358 configured to overlie the retainer box 38 when the support is in the closed position. As illustrated, the retainer box engaging portion 358 may include a recess shaped to receive the retainer box.

In some embodiments, a channel barrier 344 may include an engaging feature such as an abutment 355 (FIGS. 13-14) configured to overlie and engage at least a portion of the support barrier 354. For example, a channel barrier located at a first end of the cover 304 may include an abutment 355 configured to overlie and engage the retainer box engaging portion 358 of the support barrier 354 when the cover is closed onto the enclosure base. In this manner, the abutment 355 may press against the retainer box engaging portion 358 to reinforce the sealing about the retainer box. Similarly, a channel barrier at an opposing end of the cover may include an engaging feature (not depicted) configured to overlie and engage the slider engaging portion 356 of the support barrier, and reinforce the sealing about the zipper slider when the cover is closed.

The channel barriers and/or support barrier may be formed of a resilient material with a suitable amount of flexibility and/or compressibility that conforms to various shapes of zipper chains after repeated openings and closing of the cover. In one embodiment, the channel barriers and/or support barrier may be formed from a thermoplastic elastomer (TPE) or a thermoplastic rubber (TPR), or similar materials, such as silicone, as should be apparent to one of skill in the art. In one embodiment, the barrier materials may have a Shore A hardness of 15-20.

The enclosure base 302 may be provided with a retainer to engage the pull tab and hold the slider head in position relative to the enclosure base. In one illustrative embodiment shown in FIG. 15, the retainer 346 may include a post that is configured to pass through the opening at the end of the pull tab 38. The post 346 may protrude from the support 320 to extend into the base channel 318 between the first and second base portions. In one embodiment, the post 346 may have a cylindrical configuration and may include recesses along the length of the post, although other configurations for engaging the pull tab are contemplated. To facilitate engagement with the pull tab 38, the retainer 346 may have a tapered shape that narrows in a direction from the support 320 toward the free end of the post.

The retainer may be located on the enclosure base to engage the pull tab 38 and retain the slider head 36 in a desired position at. As shown in FIG. 15, the retainer 346 may be positioned on the support to engage the pull tab 38 when the slider head 36 is positioned against the slider receiving portion 356 of the support barrier 354. In this manner, the slider head 36 is retained in a closed position so that it does not inadvertently move from the enclosure and open the zipper.

With the zipper closed and the slider head 36 positioned in engagement with the slider receiving portion 356 of the support barrier 354, the cover 304 may be closed onto the enclosure base, as illustrated in FIGS. 16-18, to secure the first and second base portions to each other and enclose the slider head, the retainer box and portions of the zipper chain. Moreover, the peripheral channels/barriers 332, 334 on the cover 304 and the enclosure base 302 snap together to secure the cover on the base and form a barrier (e.g., including one or more barrier segments) along the periphery of the cover, and the channel barriers 344 are pressed into engagement with the zipper chain 30 to obstruct the ends of the base channel. In this manner, any potential migration of small particles and organisms, such as bed bugs, from a mattress 102 through openings in the zipper 20 of the mattress cover 100 in the vicinity of the slider head 36 and/or the retainer box 32 are contained within the enclosure.

As discussed previously, the zipper enclosure 300 may be repeatedly washed and dried in the ordinary course of use. Thus, it may be desirable to form the zipper enclosure of suitable materials, such as a polymer or other material, which can be subject to washing and drying, repeated opening and closing of the hinge, etc. without damage.

In one embodiment, the zipper enclosure 300, including the first and second base portions 308, 310 and the cover 304, may be molded from a plastic material, such as polypropylene. The enclosure may employ, without limitation, transparent material for the cover 304 and/or the enclosure base 302 to allow visual inspection of the interior of the enclosure for the presence of bed bugs and other organisms, as well as to ensure proper positioning of the slider head 36 and pull tab 38 of the zipper. The enclosure components may be molded, such as injection molding, although other fabricating processes may be used as should be apparent to one of skill in the art.

In one embodiment, the channel barriers 344 and support barrier 354 may be overmolded onto the cover 304 and the support 320 of the enclosure, respectively. However, any suitable processes, including bonding, welding and the like, may be utilized to join the channel barriers and support barrier to the cover and support, respectively, as should be apparent to one of skill in the art.

As described previously, to enhance visual inspection of the slider head 36 and pull tab 38 of the zipper through the enclosure cover, the pull tab may optionally be colored (e.g., bright green, red, blue, yellow) to provide a visual contrast with the enclosure that allows the inspector to easily see if the pull tab is properly positioned within the enclosure. For example, an inspector may have a need to quickly determine whether the zipper enclosure is appropriately installed for a large number of bedding encasements (or other appropriate articles). Using a transparent enclosure cover and a visually contrasting pull tab, an inspector can quickly peer through the cover and determine if the pull tab has been positioned to fully close the zipper.

Another illustrative method of enclosing the zipper of a mattress cover with a zipper enclosure is described in connection with FIGS. 13-16.

As shown in FIG. 13, to facilitate initial joining of the zipper tracks, including inserting the pin 34 into the slider 36, the support 320 is rotated to the open position and the post 323 is brought into engagement with the recess 325 on the second base portion 310 secure the support in the open position. As shown in FIG. 13, the slider head 36 has been pulled along the length of the zipper and is positioned at a first end of the channel 318 to fully close the zipper; the retainer pox is positioned at a second opposing end of the channel. Closing the zipper draws the first and second base portions 308, 310 of the enclosure base together.

As shown in FIG. 14, the post 323 is disengaged from the recess 325 as the support 320 is moved to the closed position. The alignment protrusions 322 on the support are received by recesses 324 on the first base portion, and as the support is moved to the closed position, the detents 328 and/or the rib 333 and channel 335 are brought into engagement, thereby securing the support to the first base portion. Additionally, when the support is moved to the closed position, the slider engaging portion 356 and the retainer box engaging portion 358 of the slider barrier 354 are brought into engagement with the slider and retainer box, respectively.

As shown in FIG. 15, the pull tab 38 is engaged with the retainer 346 to secure the slider head 36 in the closed position. In this manner, the incidence of the zipper opening due to inadvertent movement of the slider head may be minimized, if not prevented. Additionally, in some embodiments, engaging the pull tab 38 with the restrainer 346 may cause the slider head 36 to be pulled against the slider head receiving portion 356 of the support barrier 354, thereby at least partially compressing the slider receiving portion, which may aid in forming an obstruction to prevent migration of bed bugs and the like.

As shown in FIG. 16, with the slider head 36 and the pull tab 38 in the closed position, the enclosure cover 304 is closed on the enclosure base 302. The cover 304 is pushed onto the enclosure base until the fastener channels 332 along the inner periphery of the cover snap onto the protrusions 334 along the outer periphery of the enclosure base. With the cover fully closed on the enclosure base, the channel barriers 344 at each end of the cover are pushed into engagement with and conform to the shape of the portions of the zipper chain 30 extending below the ends of the cover to seal and provide barriers against migration of bed bugs and other small particles and organisms along the zipper chain. In this manner, any bed bugs that may migrate from a mattress through openings in the zipper chain may be contained within the enclosure. Thereafter, the cover 304 may be secured to the enclosure base 302 using a fastening device, such as a cable tie, to ensure that the enclosure remains closed until the fastening device is intentionally removed to gain access to the zipper components enclosed in the protective enclosure.

For purposes of this patent application and any patent issuing thereon, the indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

The use of "including," "comprising," "having," "containing," "involving," and/or variations thereof herein, is meant to encompass the items listed thereafter and equivalents thereof as well as additional items.

It should also be understood that, unless clearly indicated to the contrary, in any methods claimed herein that include more than one step or act, the order of the steps or acts of the method is not necessarily limited to the order in which the steps or acts of the method are recited.

The foregoing description of various embodiments are intended merely to be illustrative thereof and that other embodiments, modifications, and equivalents are within the scope of the invention recited in the claims appended hereto.

What is claimed is:

1. A zipper enclosure comprising:

an enclosure base configured to be attached to an article that includes a zipper for joining first and second portions of the article together when the zipper is closed, the enclosure base including a first base portion and a second base portion that is a separate component from the first base portion, the first base portion configured to be located on the first portion of the article and the second base portion configured to be located on the second portion of the article; and an enclosure cover hingedly coupled to only one of the first base portion and the second base portion, the enclosure cover configured to secure the first and second base portions to each other when the zipper is closed and the enclosure cover is closed on the enclosure base, the first and second base portions being separable from each other when the enclosure cover is released from the enclosure base.

2. The zipper enclosure of claim 1, wherein the enclosure base and the enclosure cover are configured to contain and/or obstruct migration of particles and/or organisms through the zipper enclosure when the enclosure cover is closed on the enclosure base.

3. The zipper enclosure of claim 2, wherein the enclosure base includes a first barrier segment and the enclosure cover includes a second barrier segment, the first and second barrier segments configured to cooperate with each other at an interface to form a barrier to prevent migration of particles and/or organisms across the interface when the enclosure cover is closed on the enclosure base.

4. The zipper enclosure of claim 3, wherein the first and second barrier segments are configured to cooperate with each other to secure the enclosure cover to the enclosure base when the enclosure cover is closed on the enclosure base.

5. The zipper enclosure of claim 3, wherein the first and second barrier segments are configured to cooperate with each other to produce an audible indication that the enclosure cover is secured to the enclosure base when the enclosure cover is closed on the enclosure base.

6. The zipper enclosure of claim 1, wherein the enclosure base is configured to receive a slider head and a pull tab of the zipper when the zipper is closed to join the first and second portions of the article.

7. The zipper enclosure of claim 6, wherein the enclosure base is configured to receive a retainer box of the zipper.

8. The zipper enclosure of claim 7, wherein the first and second base portions form a channel to receive the slider head and the pull tab of the zipper.

9. The zipper enclosure of claim 8, wherein the enclosure base includes a retainer configured to engage with the pull tab to retain the slider head in position within the zipper enclosure.

10. The zipper enclosure of claim 9, wherein the retainer includes a post configured to extend through an opening in the pull tab.

11. The zipper enclosure of claim 9, wherein the retainer is located in the channel.

12. The zipper enclosure of claim 1, wherein the enclosure base includes a support configured to support the first and second base portions relative to each other when the zipper is closed.

13. The zipper enclosure of claim 12, wherein the support is configured to extend across a portion of the zipper to engage the second base portion.

14. The zipper enclosure of claim 12, wherein the support is moveable between a first position in which the support does not extend across the zipper and a second position in which the support extends across the zipper to engage the second base portion.

15. The zipper enclosure of claim 14, wherein the support is movably connected to the first barrier portion by a hinge.

16. The zipper enclosure of claim 14, wherein the support is engageable with the first base portion when moved to the first position to maintain the support in the first position.

17. The zipper enclosure of claim 16, wherein the support comprises a post engageable with a recess on the first base portion.

18. The zipper enclosure of claim 14, wherein the support is configured to engage the second base portion and secure the support to the second base portion when the support is in moved to second position.

19. The zipper enclosure of claim 14, wherein the support and the second base portion are configured to cooperate with each other to produce an audible and/or tactile indication that the support is secured to the second base portion when the support is moved to the second position.

20. The zipper enclosure of claim 12, further comprising a support barrier located on the support, the support barrier including a slider engaging portion configured to engage with a zipper slider and a retainer box engaging portion configured to engage a retainer box of the zipper.

21. The zipper enclosure of claim 1, wherein the enclosure cover includes at least one channel barrier that is configured to engage at least one portion of the zipper chain when the enclosure cover is closed on the enclosure base.

22. The zipper enclosure of claim 21, wherein the at least one channel barrier is configured to conform to the portion of the zipper chain when the at least one channel barrier is moved into engagement with the portion of the zipper chain.

23. The zipper enclosure of claim 22, wherein the at least one channel barrier includes first and second channel barriers arranged to engage first and second portions of the zipper chain.

24. The zipper enclosure of claim 23, wherein the first and second channel barriers located at opposite ends of the enclosure cover are arranged to overlie the first and second portions of the zipper chain when the enclosure cover is closed on the enclosure base.

25. The zipper enclosure of claim 21, wherein the at least one channel barrier includes a pre-formed contoured engaging surface configured to match a profile of a portion of the zipper chain.

26. The zipper enclosure of claim 1, wherein the enclosure base includes at least one first alignment feature and the enclosure cover includes at least one second alignment feature, the first and second alignment features configured to align the enclosure cover with the enclosure base when the enclosure cover is closed on to the enclosure base.

27. The zipper enclosure of claim 26, wherein each of the first base portion and the second base portion includes a first alignment feature and the enclosure cover includes a pair of second alignment features that cooperate with the first alignment features to align the enclosure cover with the first and second base portions.

28. The zipper enclosure of claim 27, wherein each first alignment feature includes a receptacle and each second alignment feature includes a protrusion that is received in the receptacle as the enclosure cover is closed on the enclosure base.

29. The zipper enclosure of claim 1, further comprising a backing panel configured to support the first and second base portions to facilitate closure of the enclosure cover on the enclosure base, the backing panel to be separated from the first and second base portions by the first and second portions of the article.

30. A mattress cover for enclosing a mattress, the mattress cover comprising:

a bottom cover panel configured to enclose a bottom portion of the mattress;

a top cover panel configured to enclose a top portion of the mattress;

a zipper to removably join the top cover panel to the bottom cover panel and thereby enclose the mattress with the mattress cover, the zipper including a chain, a slider that is movable along the chain to open and close the zipper, and a pull tab extending from the slider to facilitate movement of the slider along the chain; and a zipper enclosure configured to enclose the slider and one or more portions of the chain when the zipper is closed to contain migration of particles and/or organisms through the mattress cover, the zipper enclosure including an enclosure base attached to the mattress cover adjacent the zipper and an enclosure cover configured to engage with the enclosure base to enclose the slider and the one or more portions of the chain, the enclosure base including a first base portion attached to an outer surface of the bottom cover panel and a second base portion attached to an outer surface of the top cover panel, the first and second base portions being discrete and physically separate components which are separable from each other when the enclosure cover is released from the enclosure base, the enclosure cover being hingedly coupled to only one of the first base portion and the second base portion.

31. The mattress cover of claim 30, wherein the enclosure base and the enclosure cover are configured to contain and/or obstruct migration of particles and/or organisms through the zipper enclosure when the enclosure cover is closed on the enclosure base.

32. The mattress cover of claim 31, wherein the enclosure base includes a first barrier segment and the enclosure cover includes a second barrier segment, the first and second barrier segments configured to cooperate with each other at an interface to form a barrier to prevent migration of particles and/or organisms across the interface when the enclosure cover is closed on the enclosure base.

33. The mattress cover of claim 32, wherein the first and second barrier segments are configured to cooperate with each other to secure the enclosure cover to the enclosure base when the enclosure cover is closed on the enclosure base.

34. The mattress cover of claim 32, wherein the first and second barrier segments are configured to cooperate with each other to produce an audible and/or tactile indication that the enclosure cover is secured to the enclosure base when the enclosure cover is closed on the enclosure base.

35. The mattress cover of claim 30, wherein the enclosure base is configured to receive a slider head and a pull tab of the zipper when the zipper is closed to join the first and second portions of the article.

36. The mattress cover of claim 35, wherein the enclosure base is configured to receive a retainer box of the zipper.

37. The mattress cover of claim 36, wherein the first and second base portions form a channel to receive the slider head and the pull tab of the zipper when the zipper is closed.

38. The mattress cover of claim 37, wherein the enclosure base includes a retainer configured to engage with the pull tab to retain the slider head in position within the zipper enclosure.

39. The mattress cover of claim 38, wherein the retainer includes a post configured to extend through an opening in the pull tab.

40. The mattress cover of claim 38, wherein the retainer is located in the channel.

41. The mattress cover of claim 30, wherein the enclosure base includes a support configured to support the first and second base portions relative to each other when the zipper is closed.

42. The mattress cover of claim 41, wherein the support is configured to extend across a portion of the zipper to engage the second base portion.

43. The mattress cover of claim 41, wherein the support is moveable between a first position in which the support does not extend across the zipper and a second position in which the support extends across the zipper to engage the second base portion.

44. The mattress cover of claim 43, wherein the support is movably connected to the first barrier portion by a hinge.

45. The mattress cover of claim 43, wherein the support is engageable with the first base portion when moved to the first position to maintain the support in the first position.

46. The mattress cover of claim 45, wherein the support comprises a post engageable with a recess on the first base portion to maintain the support in the first position.

47. The mattress cover of claim 43, wherein the support is configured to engage the second base portion and secure the support to the second base portion when the support is moved to the second position.

48. The mattress cover of claim 43, wherein the support and the second base portion are configured to cooperate with each other to produce an audible and/or tactile indication that the support is secured to the second base portion when the support is moved to the second positon.

49. The mattress cover of claim 41, further comprising a support barrier located on the support, the support barrier including a slider engaging portion configured to engage with the slider and a retainer box engaging portion configured to engage a retainer box of the zipper.

50. The mattress cover of claim 30, wherein the enclosure cover includes at least one channel barrier that is configured to engage at least one portion of the zipper chain when the enclosure cover is closed on the enclosure base.

51. The mattress cover of claim 50, wherein the at least one channel barrier is configured to conform to the portion of the zipper chain when the at least one channel barrier is moved into engagement with the portion of the zipper chain.

52. The mattress cover of claim 51, wherein the at least one channel barrier includes first and second channel barriers arranged to engage first and second portions of the zipper chain.

53. The mattress cover of claim 52, wherein the first and second channel barriers located at opposite ends of the enclosure cover are arranged to overlie the first and second portions of the zipper chain when the enclosure cover is closed on the enclosure base.

54. The mattress cover of claim 50, wherein the at least one channel barrier includes a pre-formed contoured engaging surface which corresponds to a profile of a portion of the zipper chain.

55. The mattress cover of claim 30, wherein the enclosure base includes at least one first alignment feature and the enclosure cover includes at least one second alignment feature, the first and second alignment features configured to align the enclosure cover with the enclosure base when the enclosure cover is closed on to the enclosure base.

56. The mattress cover of claim 55, wherein each of the first base portion and the second base portion includes a first alignment feature and the enclosure cover includes a pair of second alignment features that cooperate with the first alignment features to align the enclosure cover with the first and second base portions.

57. The mattress cover of claim 56, wherein each first alignment feature includes a receptacle and each second alignment feature includes a protrusion that is received in the receptacle as the enclosure cover is closed on the enclosure base.

58. The mattress cover of claim 30, further comprising a backing panel configured to support the first and second base portions to facilitate closure of the enclosure cover on the enclosure base, the backing panel attached to an inner surface of the bottom cover panel opposite the second base portion.

59. The mattress cover of claim 58, wherein a portion of the backing panel extends beyond the bottom cover panel to be positioned adjacent an inner surface of the top cover panel opposite the first base portion when the top cover panel is joined to the bottom cover panel.

60. A zipper enclosure comprising:

an enclosure base configured to be attached to an article that includes a zipper having a zipper chain, a zipper slider that is slidable along the zipper chain and a pull tab attached to the zipper slider to facilitate movement of the zipper slider along the zipper chain, the enclosure base configured to receive the zipper slider;

an enclosure cover hingedly attached to the enclosure base and movable between an open position to receive the zipper slider in the enclosure base and a closed position to enclose the zipper slider in the enclosure base; and at least one barrier located on the enclosure cover to engage a portion of the zipper when the cover is moved to the closed position, the barrier including a pre-formed contoured surface having a shape corresponding to the portion of the zipper.

61. The zipper enclosure of claim 60, wherein the pre-formed contoured surface includes a zipper chain engaging portion configured to overlie and engage at least a portion of the zipper chain when the cover is moved to the closed position.

62. The zipper enclosure of claim 61, wherein the pre-formed contoured surface includes at least one hem engaging portion configured to overlie and engage at least a portion of a hem located where the zipper is attached to the article.

63. The zipper enclosure of claim 62, wherein the pre-formed contoured surface includes two hem engaging portions located on opposing sides of the barrier.

64. The zipper enclosure of claim 63, wherein the zipper chain engaging portion is located between the two hem engaging portions.

65. The zipper enclosure of claim 64, wherein the pre-formed contoured engaging surface includes one or more protrusions located between the hem engaging portions and the zipper chain engaging portion, the protrusions configured to engage with portions of the zipper located between the hems and the zipper chain.

66. The zipper enclosure of claim 62, wherein the hem engaging portion has a concave curvature.

67. The zipper enclosure of claim 62, wherein the zipper chain engaging portion and/or the hem engaging portion includes two or more barrier segments separated by one or more recesses.

68. The zipper enclosure of claim 61, wherein the zipper chain engaging portion has a convex curvature.

69. The zipper enclosure of claim 60, wherein the barrier is formed from a resilient material such that the barrier deforms against the portion of the zipper when engaged with the portion of the zipper.

* * * * *